US008070286B2

(12) United States Patent
Nakagawa et al.

(10) Patent No.: US 8,070,286 B2
(45) Date of Patent: Dec. 6, 2011

(54) IMAGE RECORDING APPARATUS

(75) Inventors: Masaharu Nakagawa, Kyoto (JP); Keisuke Hirai, Kyoto (JP); Kunio Muraji, Kyoto (JP); Akira Murata, Kyoto (JP)

(73) Assignee: Dainippon Screen Mfg. Co., Ltd., Kyoto (JP)

( * ) Notice: Subject to any disclaimer, the term of this patent is extended or adjusted under 35 U.S.C. 154(b) by 473 days.

(21) Appl. No.: 12/409,106

(22) Filed: Mar. 23, 2009

(65) Prior Publication Data

US 2009/0244243 A1 Oct. 1, 2009

(30) Foreign Application Priority Data

Mar. 31, 2008 (JP) ..... 2008-090778
Mar. 31, 2008 (JP) ..... 2008-090779
Mar. 31, 2008 (JP) ..... 2008-090780
Feb. 3, 2009 (JP) ..... 2009-022577

(51) Int. Cl.
*B41J 2/01* (2006.01)

(52) U.S. Cl. ..... 347/104; 347/101; 347/4; 347/8; 271/275

(58) Field of Classification Search ..... 347/104, 347/101, 4, 8; 271/275, 197
See application file for complete search history.

(56) References Cited

U.S. PATENT DOCUMENTS 5,225,852 A 7/1993 Uchida et al.
5,828,387 A 10/1998 Wataya et al.
5,854,643 A * 12/1998 Katsuyama ..... 347/8
6,032,577 A * 3/2000 Doyle ..... 101/129
7,118,103 B2 * 10/2006 Greive ..... 271/275
2004/0201168 A1 10/2004 Greive

FOREIGN PATENT DOCUMENTS

JP 02-080269 3/1990
JP 02-187355 7/1990
JP 04-219264 8/1992
JP 2004-314605 11/2004
JP 2005-131929 5/2005
WO WO 2006/120163 A1 11/2006

OTHER PUBLICATIONS

European Search Report issued in European Patent Application No. 09004057.7, mailed May 12, 2009.

* cited by examiner

*Primary Examiner* — Matthew Luu
*Assistant Examiner* — Henok Legesse
(74) *Attorney, Agent, or Firm* — McDermott Will & Emery LLP

(57) ABSTRACT

In an image recording apparatus using an inkjet mode, printing paper fed from a paper feeder 2 is supplied onto tables 1 movable by an endless transport mechanism of a table moving mechanism 5. After each table 1 is transferred from the endless transport mechanism to linear motor mechanisms 61 of the table moving mechanism 5, an image is recorded by an image recorder 3. Subsequently, the table 1 is transferred from the linear motor mechanisms 61 to the endless transport mechanism, and then the printing paper on the table 1 is discharged by a paper discharger 4.

17 Claims, 31 Drawing Sheets

IMAGE RECORDING APPARATUS

BACKGROUND OF THE INVENTION

1. Field of the Invention

This invention relates to an image recording apparatus of the inkjet type for recording images by discharging ink from inkjet nozzles onto a recording medium.

2. Description of the Related Art

In a common image recording apparatus of the inkjet type, images are recorded by reciprocating a recording head having inkjet nozzles relative to a recording medium such as printing paper placed on a table. However, in the image recording apparatus having such construction, a long time is taken to record images on one recording medium. It is therefore impossible to carry out high-speed voluminous printing like printing with a common printing machine.

Under the circumstances, image recording apparatus have been proposed, which record images on a recording medium transported using a transport device such as rollers or belts, by discharging ink onto the recording medium in movement from numerous inkjet nozzles arranged in a direction crossing a moving direction of the recording medium (see Japanese Unexamined Patent Publications H2-80269, H2-187355, H4-219264, No. 2005-131929 and No. 2004-314605).

When a mode of transporting a recording medium using a transport device such as rollers or belts is employed, it is difficult to have the recording medium correctly held by the transport device. Therefore, when such a mode is employed, it is impossible to carry out highly precise printing.

It is conceivable to carry out highly precise printing by moving a table with a recording medium attached thereto along a circulating track, for example, and recording images on the recording medium on this table. However, in order to employ such construction, a sheet-like recording medium must be placed correctly on the surface of the table moving in one direction. It is also necessary to discharge the sheet-like recording medium from the table surface moving in one direction, and transporting the recording medium to a stocker section.

SUMMARY OF THE INVENTION

An object of this invention, therefore, is to provide an image recording apparatus which can record images at high speed and with high precision even when the inkjet mode is used.

Another object of this invention is to provides a recording medium feeder which can attach a sheet-like recording medium correctly to the surface of tables moving in one direction, and/or a recording medium transport device for discharging the sheet-like recording medium from the surfaces of the tables moving in one direction, and transporting the recording medium to a stocker section.

The above objects are fulfilled, according to this invention, by an image recording apparatus comprising an endless transport mechanism including a pair of roller members, a drive mechanism for rotating the roller members, and an endless cord member wound around the roller members; a plurality of tables each for holding a recording medium on a surface thereof; a guide mechanism for guiding the tables to be movable along a track corresponding to the endless cord member; a linear motor mechanism including a plurality of movers and a stator for reciprocating the movers along the track of movement of the tables; a first connecting mechanism including a first connector attached to the endless cord member of the endless transport mechanism, a second connector attached to each of the tables, and a first switching mechanism for switching the first connector and the second connector between a connected state and a released state; a second connecting mechanism including a third connector attached to each of the movers of the linear motor mechanism, a fourth connector attached to each of the tables, and a second switching mechanism for switching the third connector and the fourth connector between a connected state and a released state; a recording medium feed mechanism for feeding the recording medium to each of the tables in movement; a recording head disposed above the tables moved by drive of the linear motor mechanism, each in a state of having the third connector and the fourth connector connected by the second connecting mechanism, for recording an image by discharging inks onto the recording medium from a plurality of inkjet nozzles arranged in a direction crossing a moving direction of the tables; and a recording medium discharge mechanism for discharging, from each of the tables, the recording medium with the image recorded by the recording head; wherein the first switching mechanism is arranged to disconnect the first connector and the second connector before each of the tables is opposed to the recording head, and to connect the first connector and the second connector after each of the tables is opposed to the recording head; and the second switching mechanism is arranged to connect the third connector and the fourth connector before each of the tables is opposed to the recording head, and to disconnect the third connector and the fourth connector after each of the tables is opposed to the recording head.

With such image recording apparatus, a recording medium in sheet form can be attached accurately to the surface of each of the tables moving in one direction.

In a preferred embodiment, the image recording apparatus can attach the recording medium to each table while maintaining the position of the medium with high precision.

In another aspect of the invention, the recording medium feed mechanism is arranged to attach the recording medium in sheet form to the surface of each of the tables moving in one direction, the recording medium feed mechanism including a table clamp disposed at a forward end in the moving direction of each of the tables; a transport mechanism for transporting the recording medium toward the surface of each of the tables from a direction above the tables and at a small intersecting angle to the surface of each of the tables, and at a speed slightly faster than a moving speed of the tables; and a clamp operating mechanism for closing the table clamp when the forward end of the recording medium transported by the transport mechanism reaches the table clamp, to fix the recording medium to each of the tables with the table clamp.

In a further aspect of the invention, the recording medium discharge mechanism is arranged to discharge the recording medium in sheet form from the surface of each of the tables moving in one direction, and transport the recording medium to a stocker section; each of the table having a table clamp disposed at a forward end in the moving direction thereof for fixing the recording medium, and cutouts formed at the forward end for peeling off the recording medium; the recording medium discharge mechanism including a first peeling claw for moving into the cutouts for peeling, and peeling a forward end of the recording medium from each of the tables; a claw seat for pinching the forward end of the recording medium and transporting the recording medium with the first peeling claw; a discharge cylinder for winding peripherally thereof the recording medium pinched and transported by the first peeling claw and the claw seat to separate the recording medium from each of the tables; a second peeling claw for peeling the recording medium from the discharge cylinder; a first conveyor for receiving and transporting thereon the recording medium peeled from the discharge cylinder by the second peeling claw; a second conveyor for holding by suction from above and transporting the recording medium transported by the first conveyor; and the stocker section for collecting the recording medium falling upon cancellation of suction holding after being transported by the second conveyor.

Other features and advantages of the invention will be apparent from the following detailed description of the embodiments of the invention.

BRIEF DESCRIPTION OF THE DRAWINGS

For the purpose of illustrating the invention, there are shown in the drawings several forms which are presently preferred, it being understood, however, that the invention is not limited to the precise arrangement and instrumentalities shown.

DESCRIPTION OF THE PREFERRED EMBODIMENTS

Figure 1:
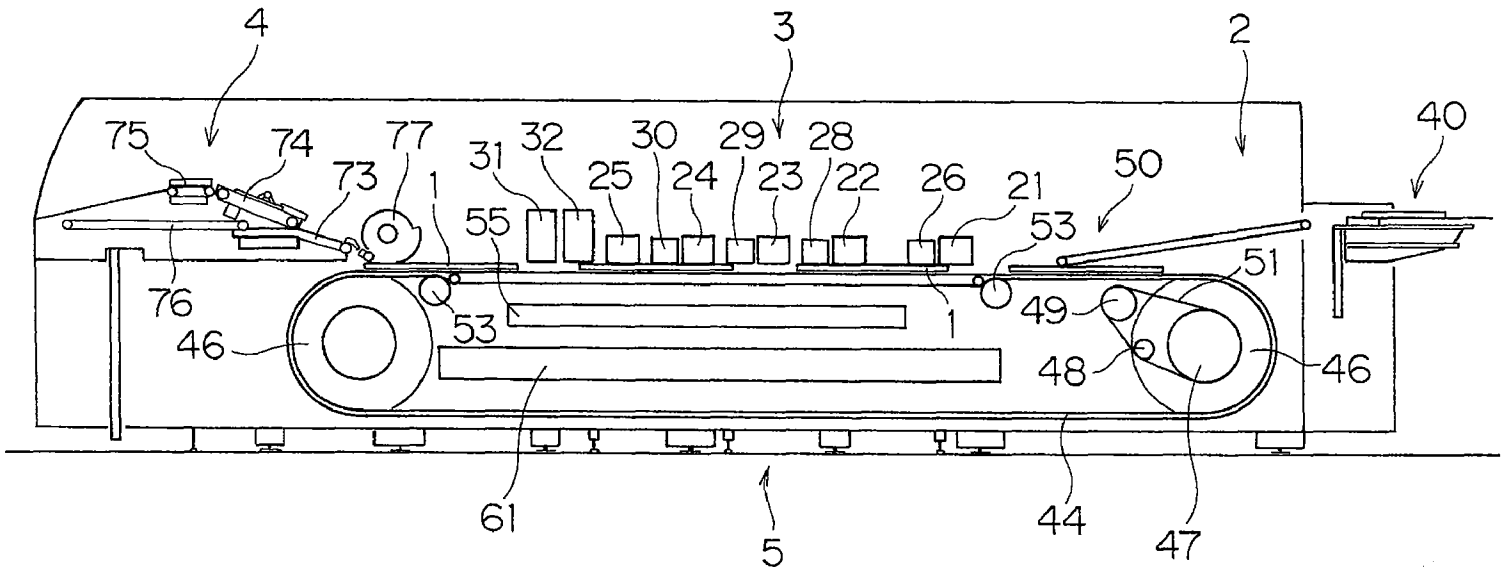
FIG. 1 is a schematic side view of an image recording apparatus according to this invention.
Figure 2:
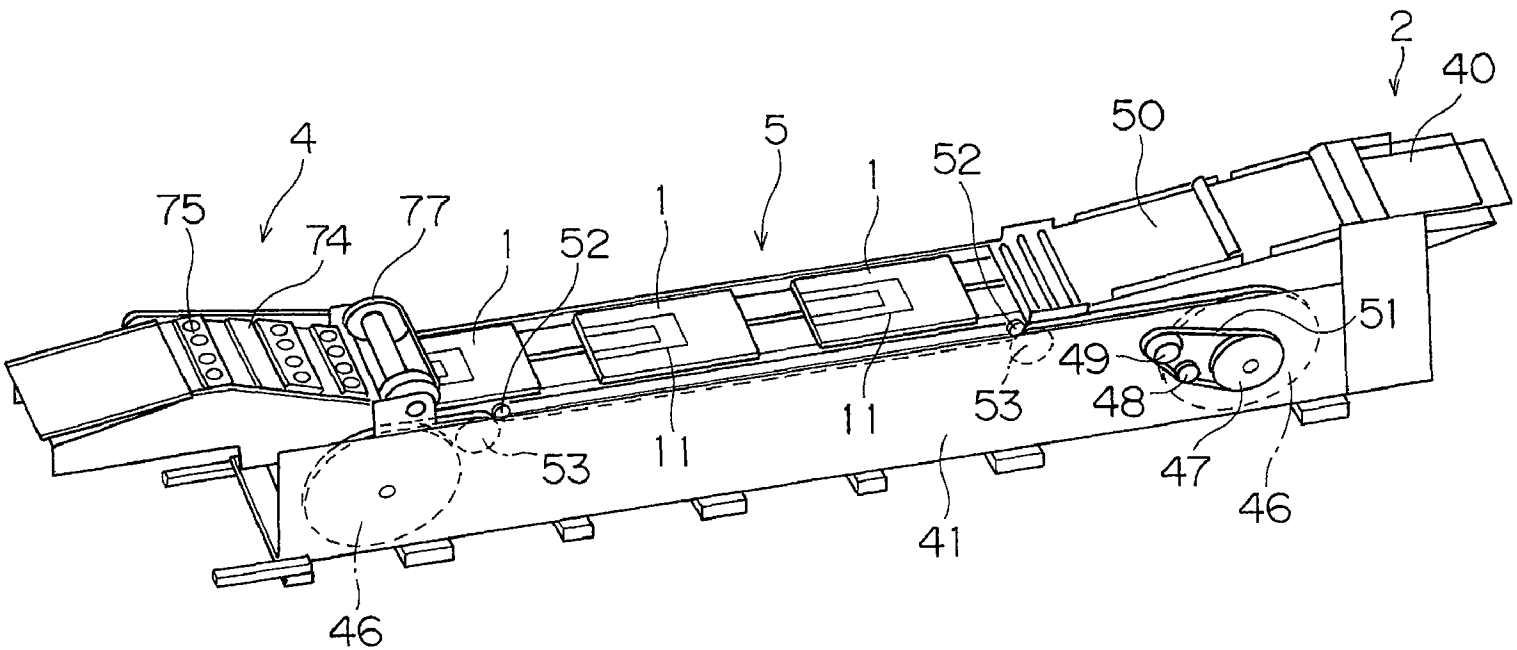
FIG. 2 is a perspective view of the image recording apparatus according to this invention, with an image recording unit omitted.

An embodiment of this invention will be described hereinafter with reference to the drawings. FIG. 1 is a schematic side view of an image recording apparatus according to this invention. FIG. 2 is a perspective view of the image recording apparatus according to this invention, with an image recording unit 3 omitted.

This image recording apparatus records images on printing paper serving as a recording medium held on tables 1 by suction using suction holes 11. The apparatus includes a paper feeder 2, a paper discharger 4, a table moving mechanism 5 for moving ten tables 1 arranged at regular intervals along a circulating track, and an image recording unit 3 for recording images on the printing paper on the tables 1 moved by the table moving mechanism 5. The constructions of image recording unit 3, table moving mechanism 5, paper feeder 2 and paper discharger 4 will be described hereinafter in the stated order.

The image recording unit 3 records images in an inkjet mode on the printing paper held by suction on the upper surfaces of tables 1 moved in one direction by the table moving mechanism 5. This image recording unit 3 includes a pretreatment agent coating head 21, four recording heads 22, 23, 24 and 25, five heaters 26, 28, 29, 30 and 31, and a scanner 32.

The pretreatment agent coating head 21 applies a transparent pretreatment agent to the printing paper before the four recording heads 22, 23, 24 and 25 record images.

The four recording heads consist of a recording head 22 for black ink, a recording head 23 for cyan ink, a recording head 24 for magenta ink, and a recording head 25 for yellow ink. The recording heads 22, 23, 24 and 25 are arranged above the tables 1 movable in one direction. These recording heads 22, 23, 24 and 25 have numerous inkjet nozzles arranged in a direction perpendicular to the moving direction of the tables 1, and discharge the inks onto the printing paper to record images thereon.

The five heaters consist of a preheating heater 26, intermediate heaters 28, 29 and 30, and a main heater 31. These heaters 26, 28, 29, 30 and 31 are constructed to blow hot air to the printing paper. The scanner 32 has a linear CCD camera for measuring the density of entire images and/or patches recorded.

The table moving mechanism 5 moves the ten tables 1 at high speed along the circulating track by means of an endless transport mechanism. At a time of recording images, the table moving mechanism 5 separates these tables 1 from the endless transport mechanism, and moves the tables 1 accurately by means of linear motor mechanisms. At this time, the tables 1 are guided by rails of a linear guide. A first and second connecting mechanisms are used to switch the movement of tables 1 between the endless transport mechanism and the linear motor mechanisms.

Figure 3:
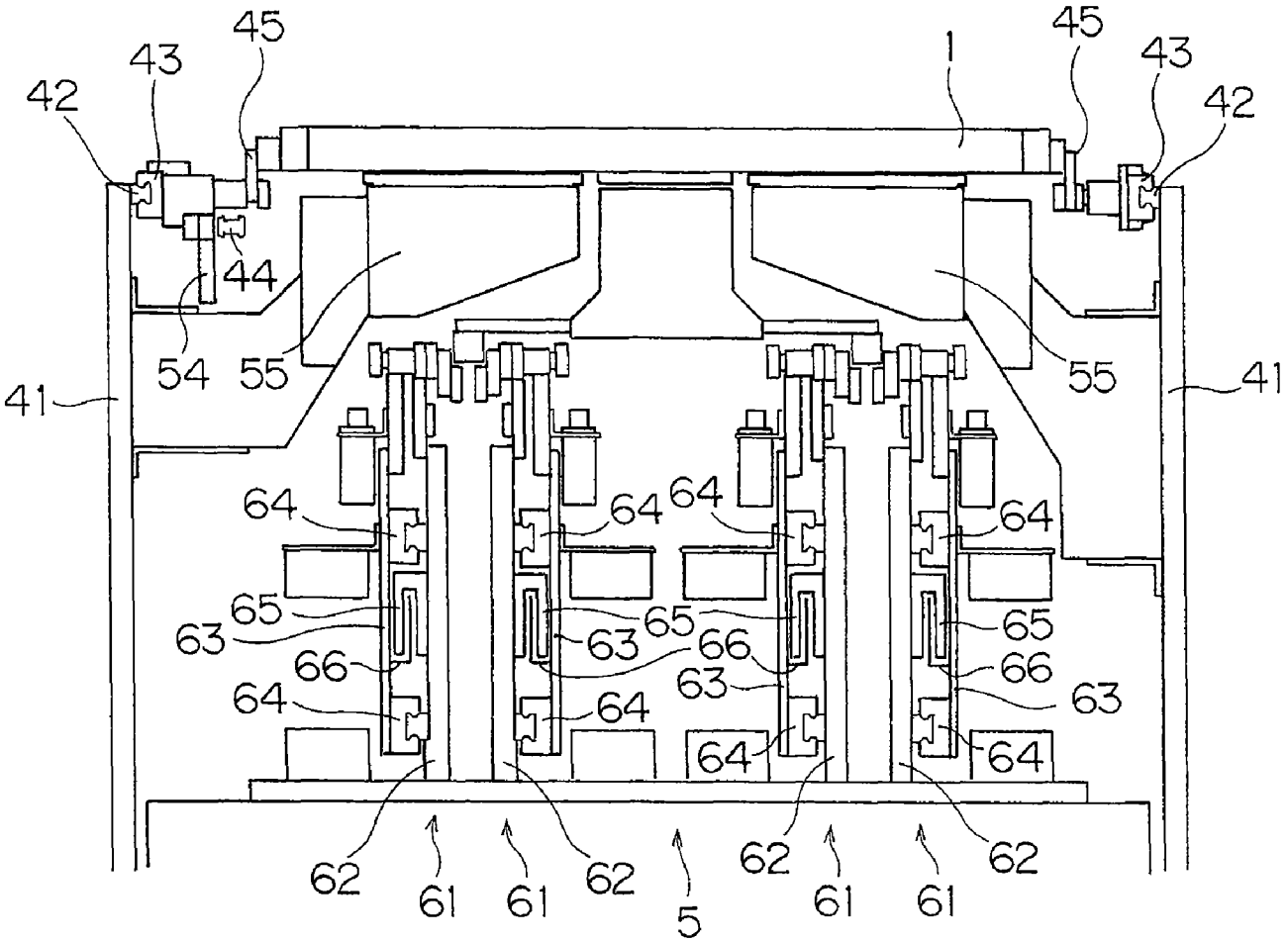
FIG. 3 is a view in vertical section showing a principal portion of a table moving mechanism.
Figure 4:
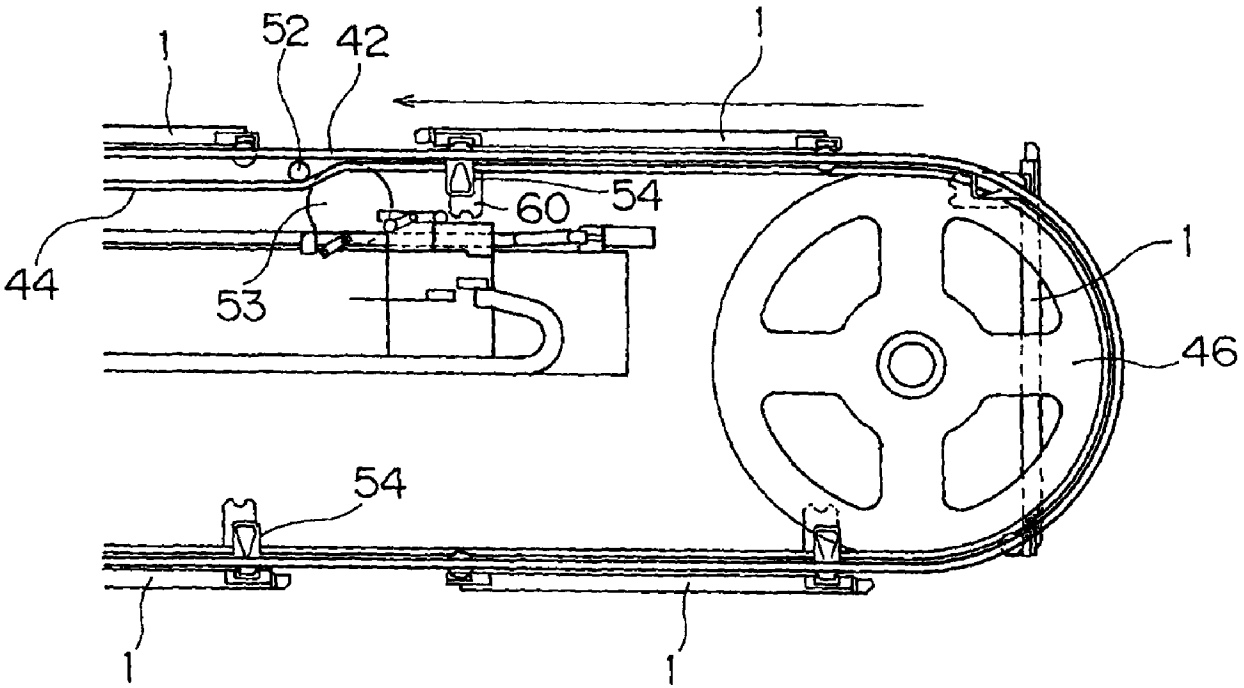
FIG. 4 is a fragmentary side view showing connections between a rail of a linear guide, a chain and tables.
Figure 5:
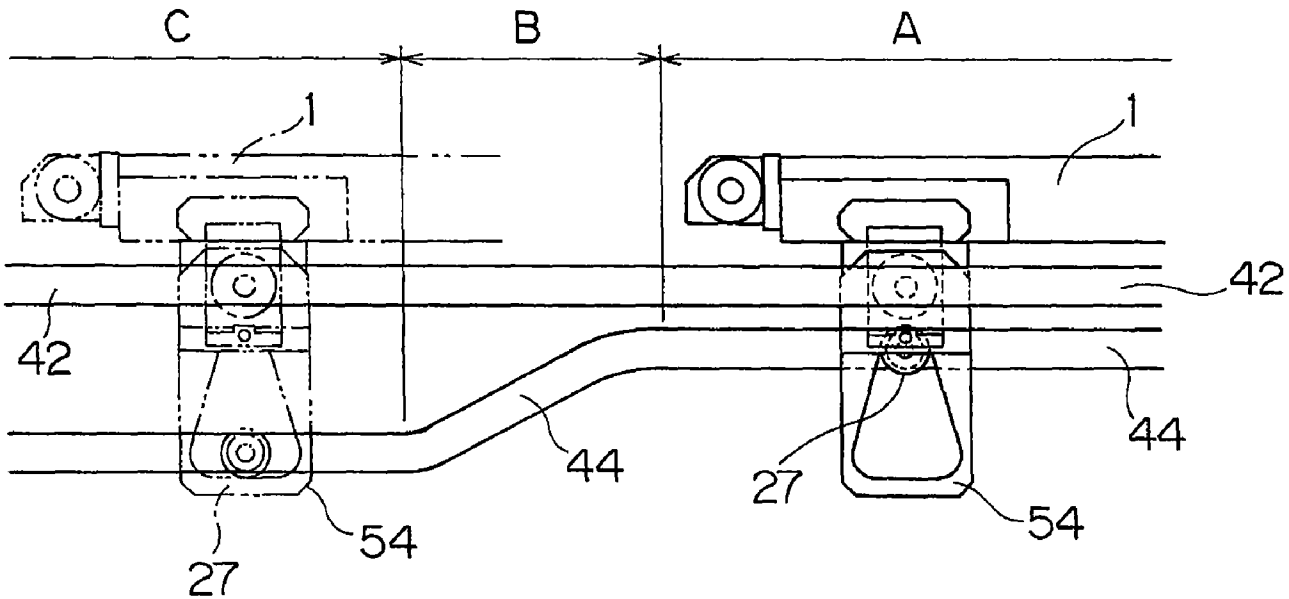
FIG. 5 is an enlarged fragmentary view showing the connections between the rail of the linear guide, chain and tables.
Figure 6:
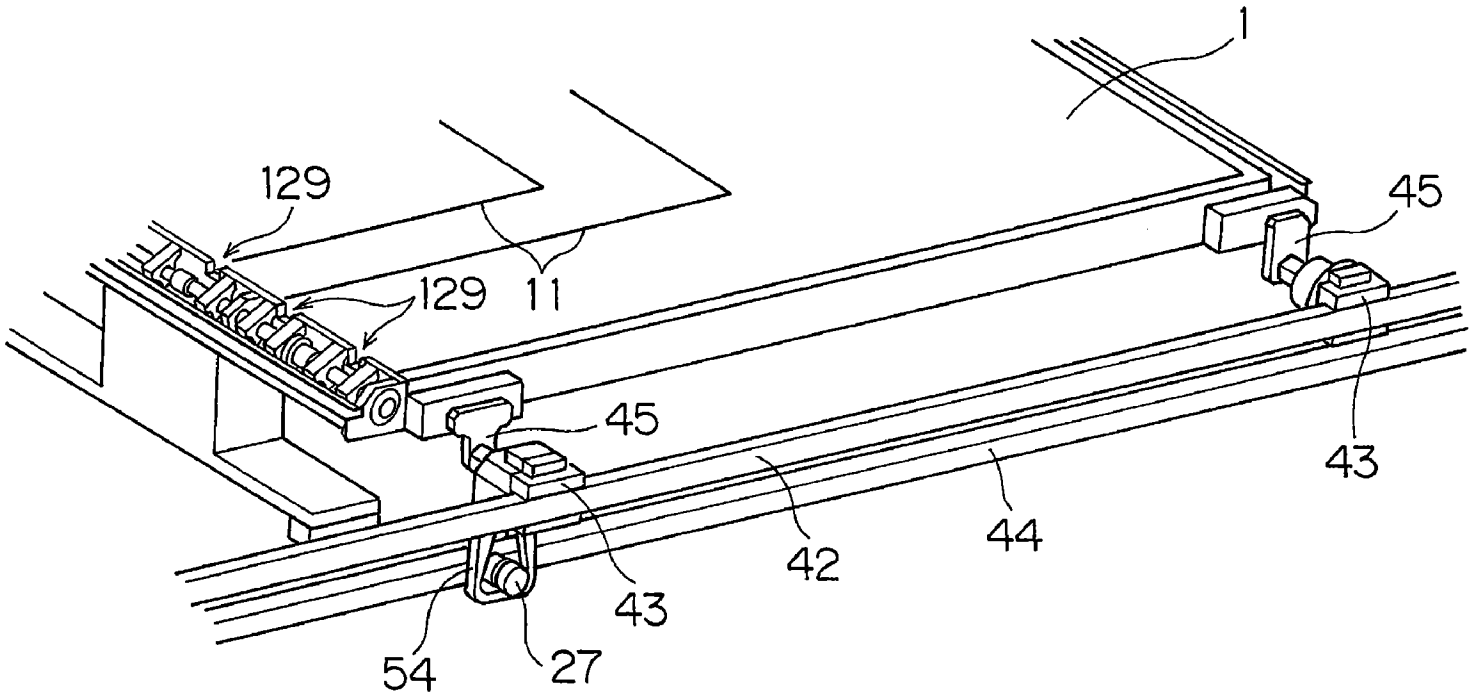
FIG. 6 is a fragmentary perspective view showing the connections between the rail of the linear guide, chain and tables.

FIG. 3 is a view in vertical section showing a principal portion of the table moving mechanism 5. FIG. 4 is a fragmentary side view showing a connection between a rail 42 of the linear guide, a chain 44 and the tables 1. FIG. 5 is an enlarged fragmentary view showing the connection between the rail 42 of the linear guide, chain 44 and tables 1. FIG. 6 is a fragmentary perspective view showing the connection between the rail 42 of the linear guide, chain 44 and tables 1.

Each table 1 has receivers 43 of the linear guide attached to four corners thereof through connectors 45. The receivers 43 are engaged with a pair of right and left rails 42 of the linear guide arranged on side plates 41. The rails 42 have an endless shape. Thus, each table 1 is movable along the circulating track as guided by the endless linear guide including the rails 42 and receivers 43.

One of the side plates 41 has a pair of sprockets 46 rotatably arranged thereon. The chain 44 is wound around these sprockets 46. The chain 44 wound around the sprockets 46, and the endless linear guide including the rails 42 and receivers 43, have shapes corresponding to each other. As shown in FIGS. 1 and 2, one of the sprockets 46 has a sprocket 47 disposed laterally thereof. This sprocket 47 is connected, by a chain 51, to a drive sprocket 48 rotatable by a motor and to a driven sprocket 49. Thus, by drive of the drive sprocket 48, the chain 44 is rotatable as wound around the pair of sprockets 46.

As shown in FIGS. 2 and 4, the chain 44 has a height varied in intermediate positions thereof by the action of two pairs of sprockets 52 and 53.

The pair of sprockets 46 constitute roller members in the endless transport mechanism, and the chain 44 acts as a cord member in the endless transport mechanism. The chain 44 may be replaced with a synchronous belt, and the sprockets 46 with synchronous pulleys.

As shown in FIG. 3, four linear motor mechanisms 61 are arranged in a lower part of an apparatus main frame. Each linear motor mechanism 61 includes a support plate 62 erected on the main frame, a moving base 63 opposed to the support plate 62, and a pair of linear guides 64 for connecting the moving base 63 and support plate 62, and guiding the moving base 63 to be horizontally movable relative to the support plate 62. The support plate 62 has a stator 65 of a linear motor fixed thereto, while the moving base 63 has movers 66 of the linear motor fixed thereto.

Each linear motor mechanism 61 can move the movers 66 at a desired speed in the moving direction of tables 1 and in the opposite direction by carrying out magnetic pole variations of the stator 65 extending in the moving direction of tables 1.

Thus, each moving base 63 is movable back and forth in a direction perpendicular to the plane of FIG. 3, i.e. along the moving direction of tables 1, by the linear motor including the stator 65 and movers 66. The moving bases 63 and tables 1 are switchable between a connected state and a released state by second connecting mechanisms to be described hereinafter.

As noted above, the tables 1 are transported by the linear motor mechanisms 61 at a time of recording images, and are transported by the endless transport mechanism using the chain 44 at other times. That is, the chain 44 and tables 1 are disconnected before recording of images, i.e. before the tables 1 are opposed to the pretreatment agent coating head 21. The chain 44 and tables 1 are connected after recording of images, i.e. after the tables 1 are opposed to the last recording head 25 and the main heater 31. This switching of connection is carried out by a first connecting mechanism to be described hereinafter.

The movers 66 of the linear motor mechanisms 61 and the tables 1 are connected before recording of images, i.e. before the tables 1 are opposed to the first recording head 22, and are disconnected after recording of images, i.e. after the tables 1 are opposed to the last recording head 25 and the scanner 32. This switching of connection is carried out by the second connecting mechanisms to be described hereinafter.

As shown in FIGS. 1 and 3, suction fans 55 are arranged under the moving track of tables 1. The tables 1 have a hollow structure. As shown in FIGS. 2 and 6, the tables 1 have suction holes 11 formed in the surfaces thereof to communicate with the inner spaces. Thus, by exhausting air from the suction fans 55, the printing paper supplied to the surfaces of tables 1 can be held on the tables 1 by suction.

Next, the construction of the first connecting mechanism for switching the chain 44 and tables 1 between the connected state and released state will be described.

As shown in FIGS. 5 and 6, the chain 44 has connecting pins 27 attached thereto, each to act as a first connector. On the other hand, each table 1 has a connecting plate 54 attached to a forward end in the moving direction thereof to act as a second connector. The connecting plate 54 defines a substantially triangular bore pointing upward. The connecting pin 27 is inserted into the bore of the connecting plate 54.

As noted hereinbefore, the chain 44 has a height varied in intermediate positions thereof by the action of the two pairs of sprockets 52 and 53. That is, the chain 44 is in a lower position where the tables 1 are opposed to the image recording unit 3, and is raised in opposite end regions. Where the chain 44 is raised, as shown in solid lines in FIG. 5, the connecting pin 27 is in contact with a corner of the substantially triangular bore of the connecting plate 54, so that the connecting pin 27 and connecting plate 54 are connected to each other. On the other hand, where the chain 44 is in the lower position, as shown in phantom lines in FIG. 5 and in solid lines in FIG. 6, the connecting pin 27 is located away from the corner of the substantially triangular bore of the connecting plate 54, so that the connecting pin 27 and connecting plate 54 are disconnected.

The connecting pin 27 and connecting plate 54 are connected to each other when each table 1 moving as driven by the chain 44 is located in a region A shown in FIG. 5. The connecting pin 27 and connecting plate 54 are disconnected when each table 1 is located in a region B shown in FIG. 5. In a region C shown in FIG. 5, the driving source of the table 1 is switched from the chain 44 to the movers 66 of the linear motor mechanisms 61.

Next, the constructions of the second connecting mechanisms for switching the movers 66 of the linear motor mechanisms 61 and each table 1 between the connected state and released state will be described.

Figure 7:
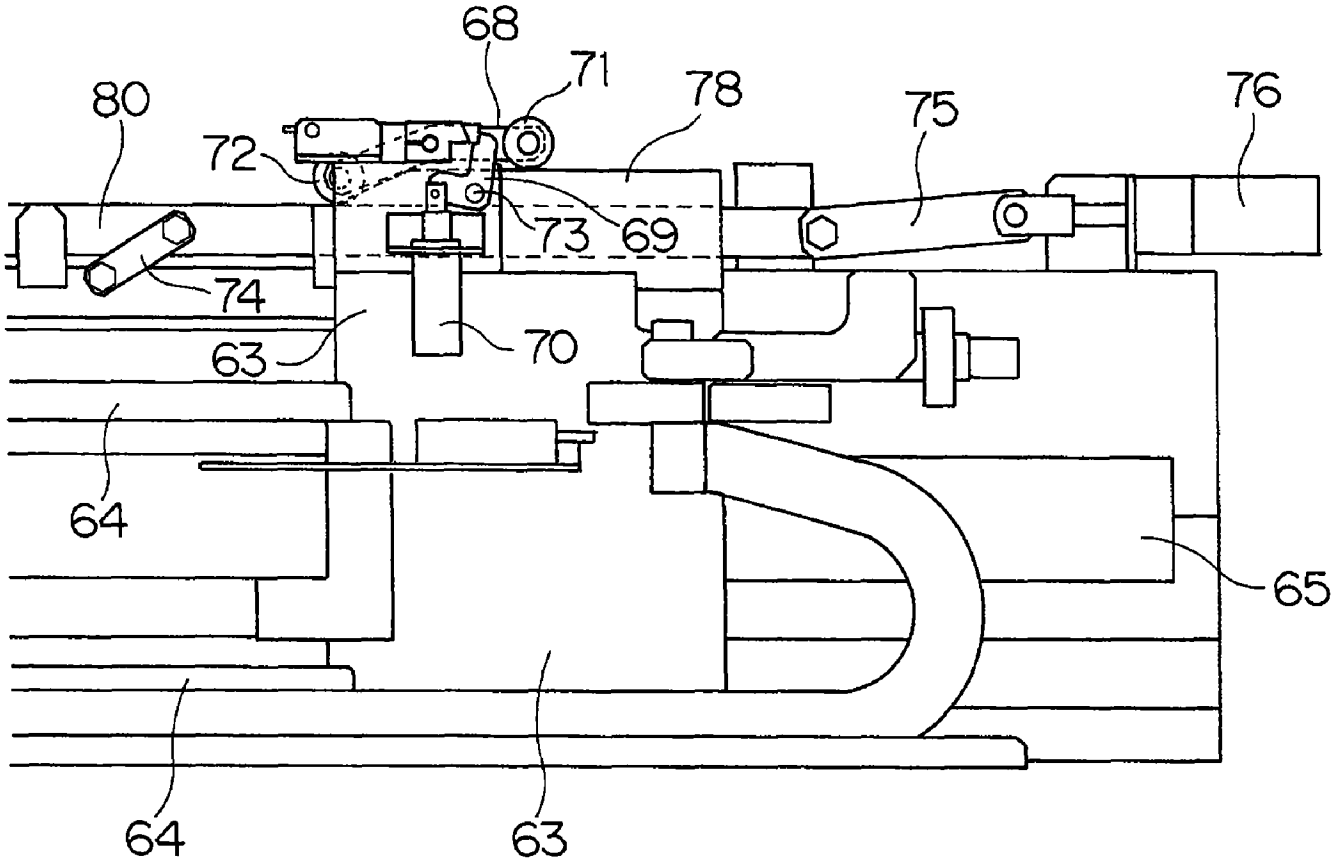
FIG. 7 is a side view showing a second connecting mechanism.
Figure 8:
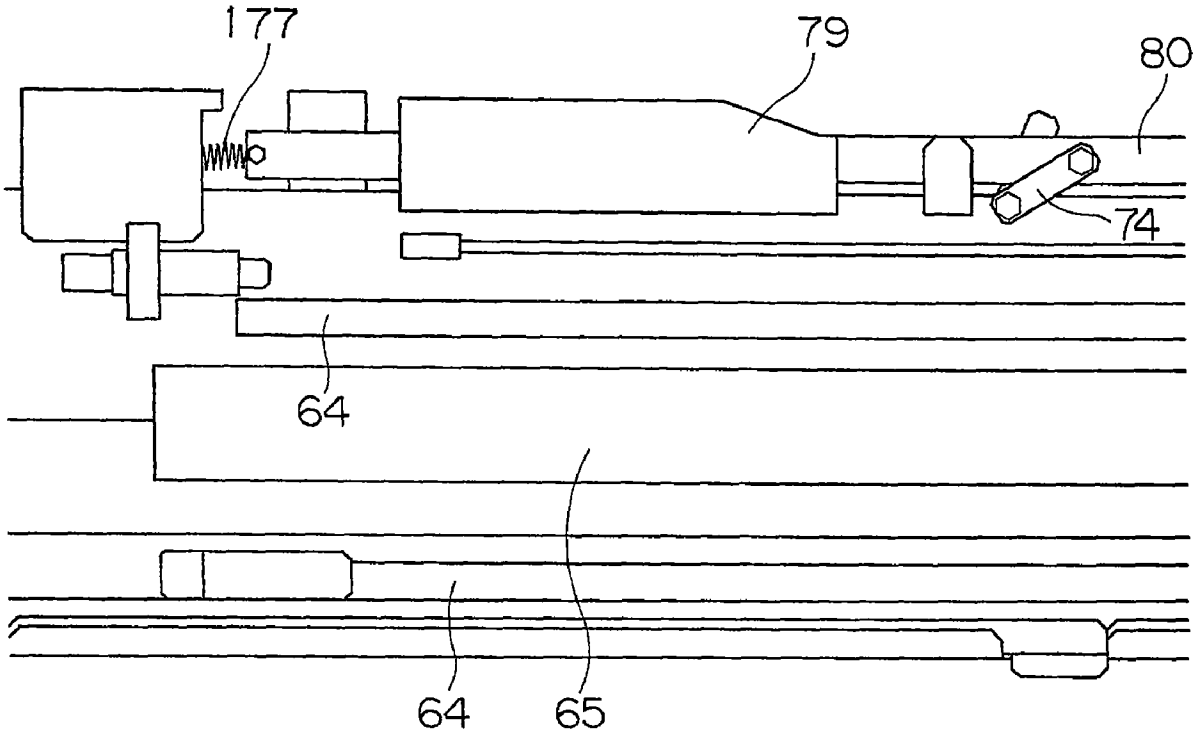
FIG. 8 is a side view showing another second connecting mechanism.

FIGS. 7 and 8 are side views showing the second connecting mechanisms. FIG. 7 shows a second connecting mechanism adjacent the paper feeder 2, while FIG. 8 shows a second connecting mechanism adjacent the paper discharger 4. FIGS. 9 through 12 are explanatory views showing connecting and releasing operations of the second connecting mechanisms.

As shown in FIGS. 9 through 12, each table 1 has a V-block 60 attached to the lower surface thereof to act as a fourth connector. Each moving base 63 connected to the needle 66 of the linear motor has a latch lever 68 mounted on the upper end thereof to be rockable about an axis 67. The latch lever 68 has a cam follower 72 attached to one end thereof to act as a third connector. The cam follower 72 can contact a recess formed in the V-block 60 to connect the latch lever 68 and the V-block 60. The latch lever 68 has a cam follower 71 attached to the other end thereof. The moving base 63 has also a lock lever 69 mounted on the upper end thereof to be rockable about an axis 73.

As shown in FIGS. 7 and 8, below the cam follower 71 noted above, a moving cam 80 extends in the moving direction of tables 1. The moving cam 80 has a pair of fixed cams 78 and 79 arranged at opposite ends thereof in the moving direction of tables 1.

The moving cam 80 is connected to the apparatus main frame through rocking levers 74. One end of this moving cam 80 is connected to an air cylinder 76 through a link lever 75. The other end of the moving cam 80 is connected to the apparatus main frame through a tension spring 177. Thus, when the air cylinder 76 presses the moving cam 80 through the link lever 75 leftward in FIGS. 7 and 8, the rocking levers 74 rock and raise the moving cam 80.

Figure 9:
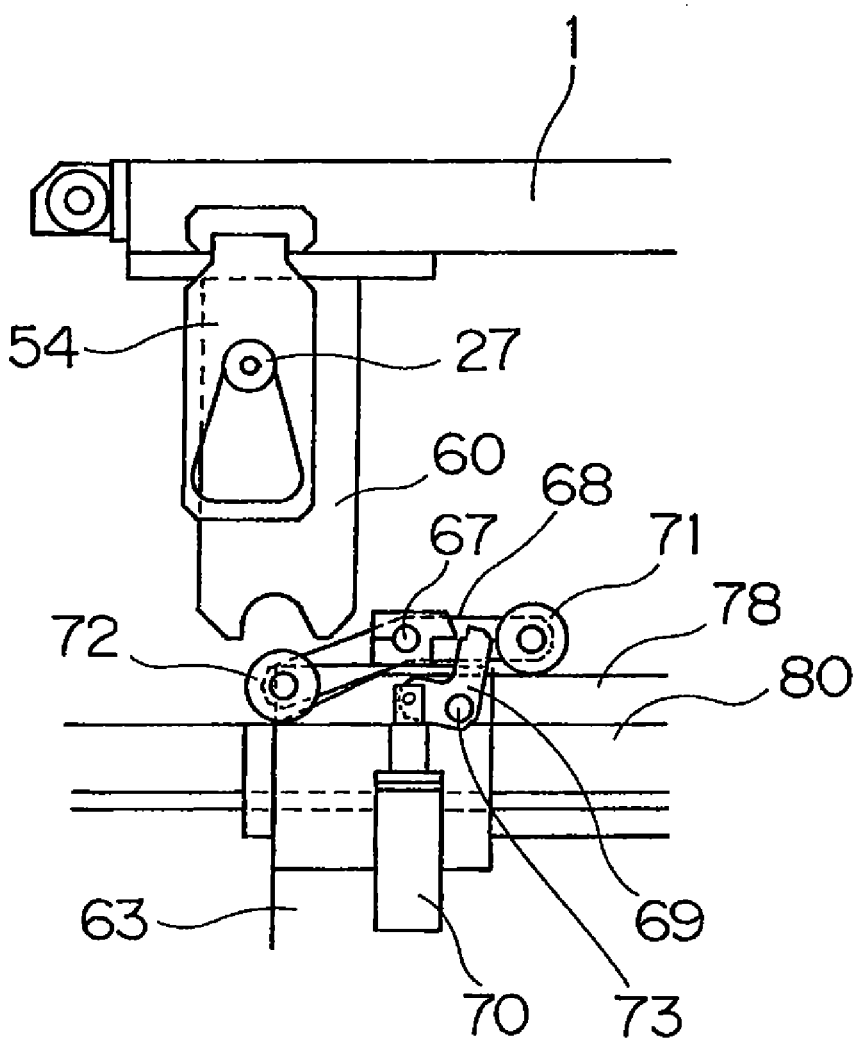
FIG. 9 is an explanatory view showing connecting and releasing operations of the second connecting mechanisms.

When the moving base 63 is located at the end adjacent the paper feeder 2, as shown in FIG. 9, the cam follower 71 rides on the fixed cam 78, and the cam follower 72 is in a lowered position. When, in this state, the table 1 moves as driven by the chain 44, with the recess of V-block 60 reaching a position over the cam follower 72, the moving base 63 starts moving as driven by the linear motor mechanism 61.

Figure 10:
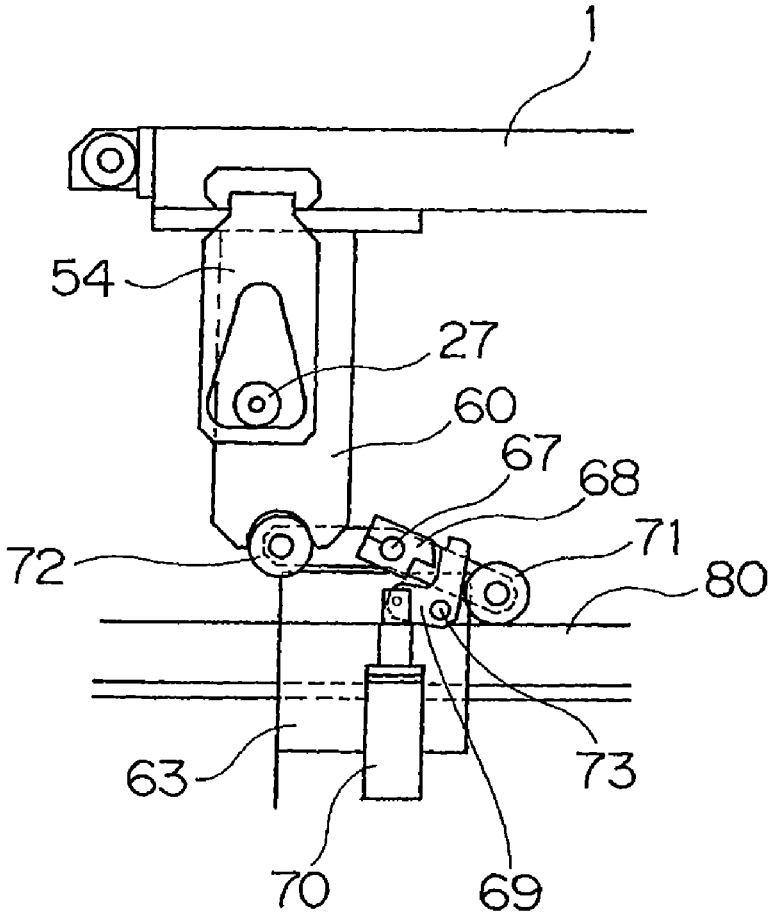
FIG. 10 is an explanatory view showing connecting and releasing operations of the second connecting mechanisms.

Then, as shown in FIG. 10, the cam follower 71 moves from the fixed cam 78 onto the moving cam 80. This rocks the latch lever 68, and moves the cam follower 72 into contact with the recess of V-block 60, thereby connecting the cam follower 72 and V-block 60. In this state, the table 1 is connected to the movers 66 of each linear motor mechanism 61. And in this state, the table 1 is moved by the drive of the linear motor mechanism 61. At this time, the table 1 moves in one direction by the drive of the linear motor mechanism 61 which is more accurate than the drive of the endless transport mechanism using the chain 44.

Figure 11:
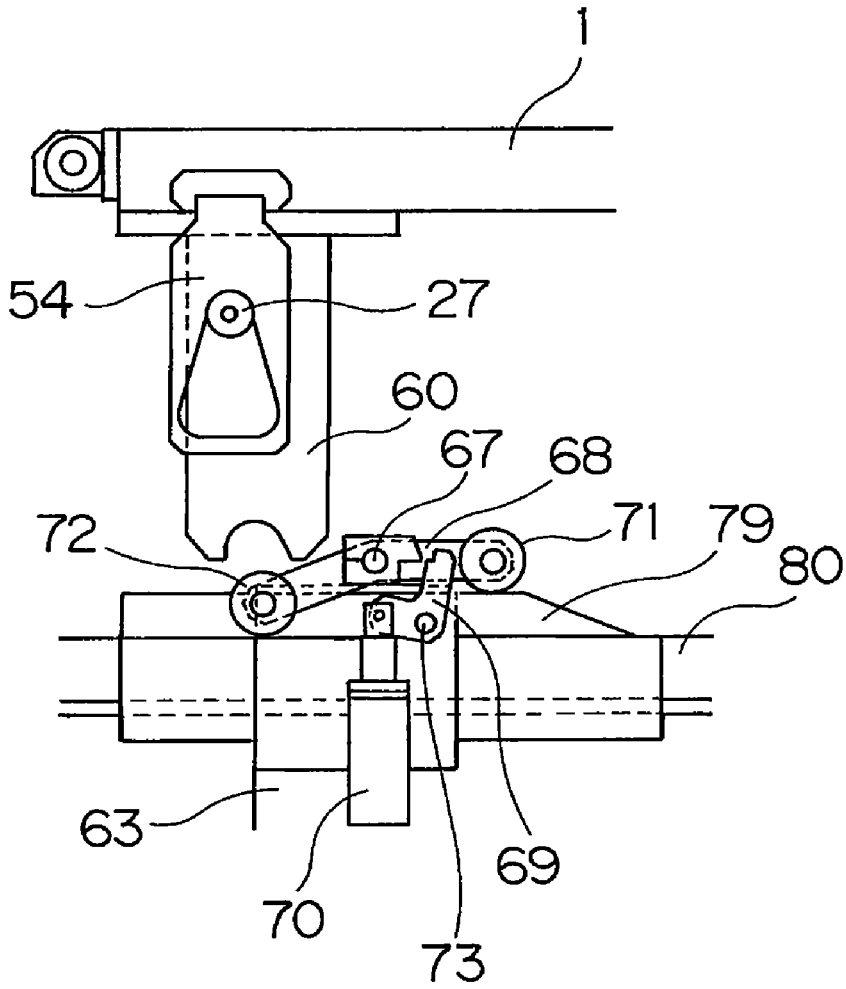
FIG. 11 is an explanatory view showing connecting and releasing operations of the second connecting mechanisms.

When the moving base 63 is located at the end adjacent the paper discharger 4, as shown in FIG. 11, the cam follower 71 moves from the moving cam 80 onto the fixed cam 79. This rocks the latch lever 68, and moves the cam follower 72 out of contact with the recess of V-block 60, thereby disconnecting the cam follower 72 and V-block 60. In this state, the table 1 is disconnected from the movers 66 of each linear motor mechanism 61. The table 1 continues moving as driven by the chain 44 noted above.

Figure 12:
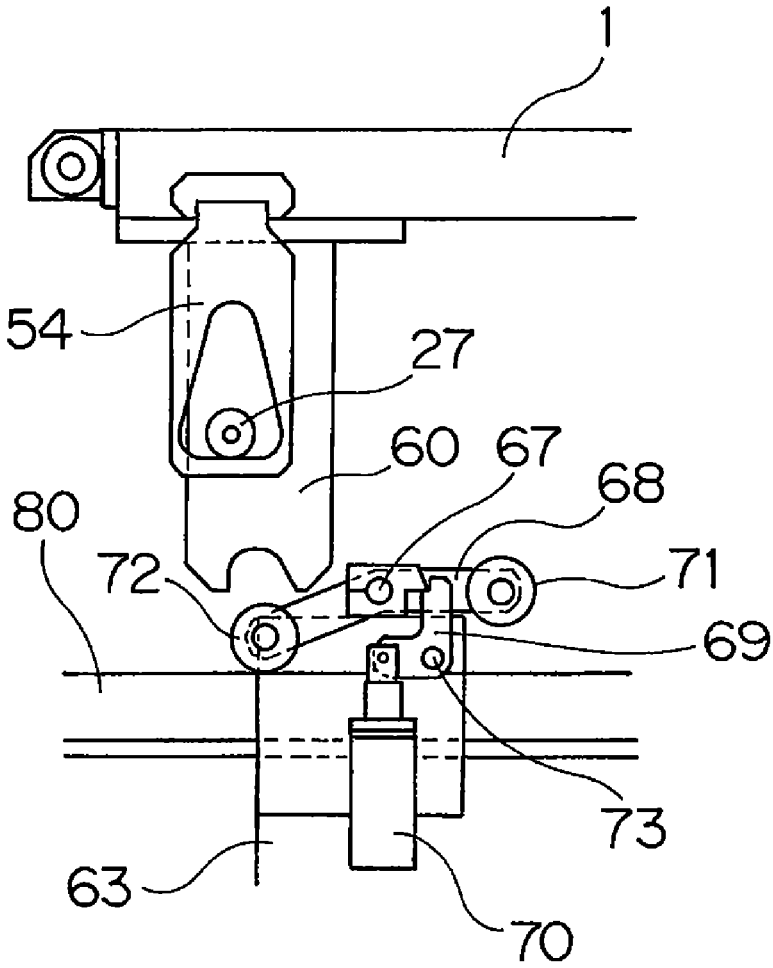
FIG. 12 is an explanatory view showing connecting and releasing operations of the second connecting mechanisms.

On the other hand, the moving base 63 is driven by the linear motor mechanism 61 to return from the end adjacent the paper discharger 4 to the end adjacent the paper feeder 2. At this time, as shown in FIG. 12, the air cylinder 70 drives the lock lever 69 to rock about the axis 73. This fixes the latch lever 68 to the position having the cam follower 72 disengaged from the V-block 60. In this state, the linear motor mechanism 61 moves the moving base 63 from the end adjacent the paper discharger 4 to the end adjacent the paper feeder 2. Since the latch lever 68 is fixed to the position having the cam follower 72 disengaged from the V-block 60 at this time, the cam follower 72 and other elements moving in the direction opposite to the moving direction of the table 1 are prevented from interfering with the V-block 60 and other elements.

Figure 13:
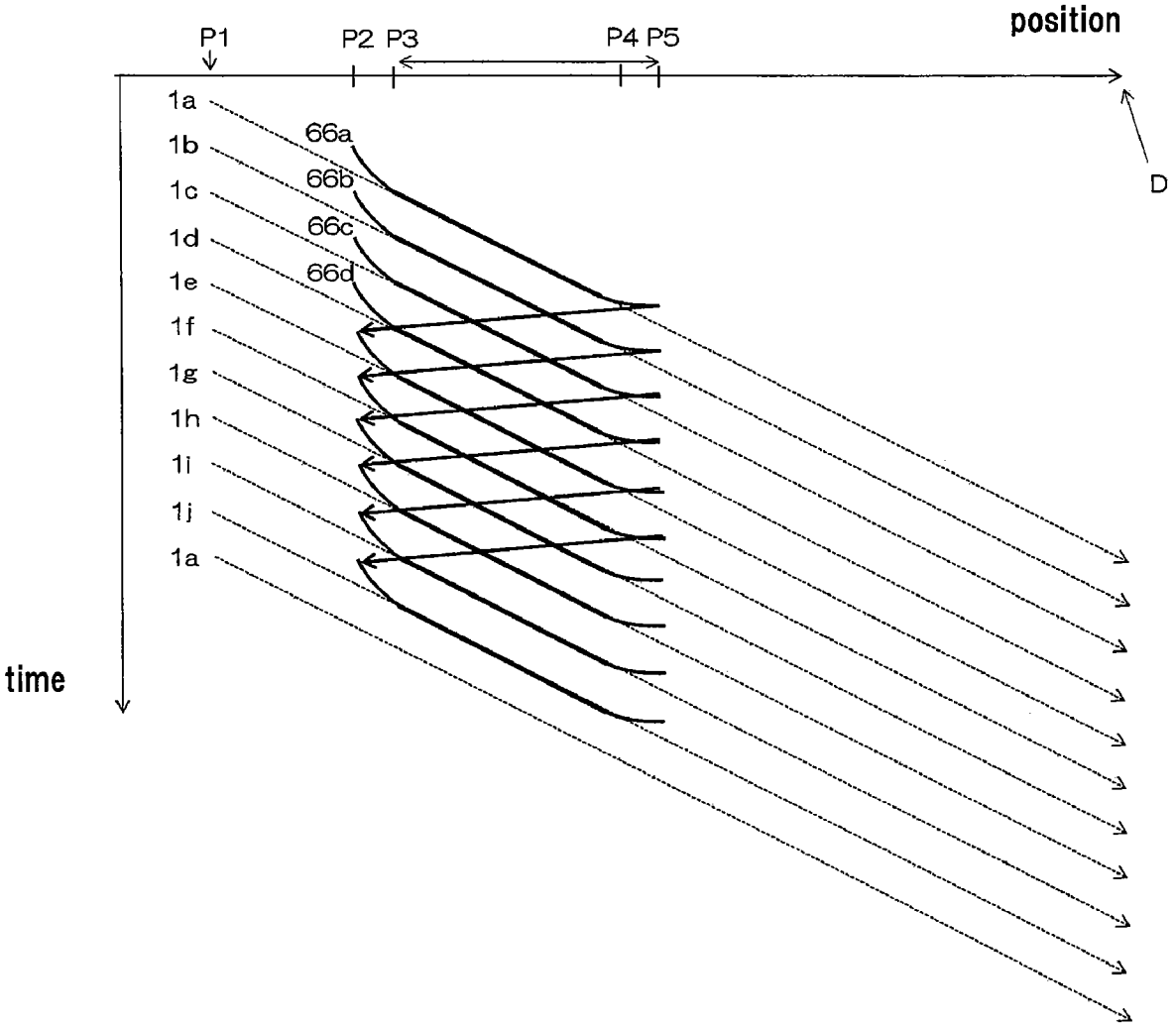
FIG. 13 is a timetable showing how ten tables are moved by four linear motor mechanisms.

FIG. 13 is a timetable showing how the ten tables 1 are moved by the movers 66 of the four linear motor mechanisms 61. In FIG. 13, suffixes a through j are attached to the plurality of tables 1 for distinguishment. Similarly, suffixes a through d are attached to the plurality of movers 66 for distinguishment.

The linear motor mechanism 61 having moved the first table 1*a* returns from the end adjacent the paper discharger 4 to the end adjacent the paper feeder 2, and moves the fifth table 1*e* next. Similarly, the linear motor mechanism 61 having moved the second table 1*b* returns from the end adjacent the paper discharger 4 to the end adjacent the paper feeder 2, and moves the sixth table 1*f* next. In drive ranges other than the drive range by the linear motor mechanisms shown in FIG. 13, each table 1 is moved by the endless transport mechanism having the chain 44. Reference D in FIG. 13 indicates a position of origin to which the tables 1 return after moving around along the circulating track. In FIG. 13, home position P1, position P2, position P3, position P4 and position P5 are plotted as coordinates on the circulating track.

Home position P1 is located in a position adjacent the paper feeder 2, where the chain 44 and connecting pin 27 are connected, and each table 1 is driven by the chain 44 to move along the circulating track. Position P2 corresponds to a movement start position of the movers 66 of each linear motor mechanism 61. In this position also, each table 1 is driven by the chain 44 to move along the circulating track. Position P3 is a position where each table 1 and mover 66 are connected by the cam follower 72 connecting to the recess of V-block 60 as shown in FIG. 10. This is also the position where the chain 44 and connecting pin 27 are disconnected. The movers 66 start acceleration in position P2 to equal the moving speed of the chain 44 in position P3. Each table 1 is opposed to the pretreatment agent coating head 21 between position P3 and position P4.

Position P4 is a position where the movers 66 of linear motor mechanisms 61 and tables 1 become disconnected. It is assumed that the connection between the connecting pin 27 and connecting plate 54 is completed slightly upstream of position P4. Each table 1 is opposed to the main heater 31 between position P4 and position P5. Position P5 corresponds to a movement end position of the movers 66 of each linear motor mechanism 61. After being disengaged from the table 1 in position P4, the movers 66 slow down gradually and stops in position P5.

After stopping in position P5, the movers 66 move at high speed in the direction opposite to the moving direction of tables 1, as far as position P2. At this time, as described with reference to FIG. 12, the moving cam 80 is lowered for the lock lever 69 to fix the latch lever 68, whereby the cam follower 72 is fixed to the position not interfering with the recess of V-block 60.

Figure 14:
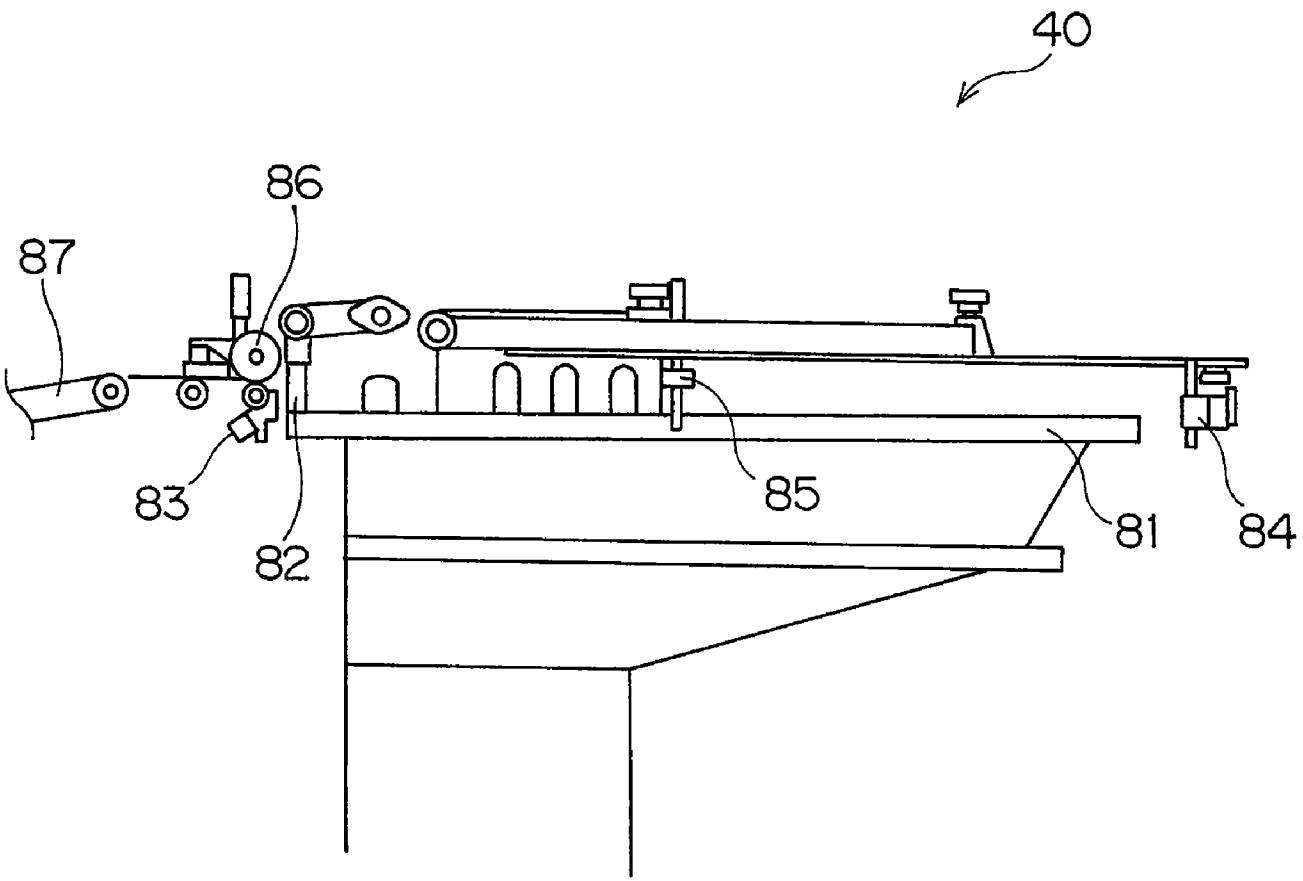
FIG. 14 is a side view of a stocker section.
Figure 15:
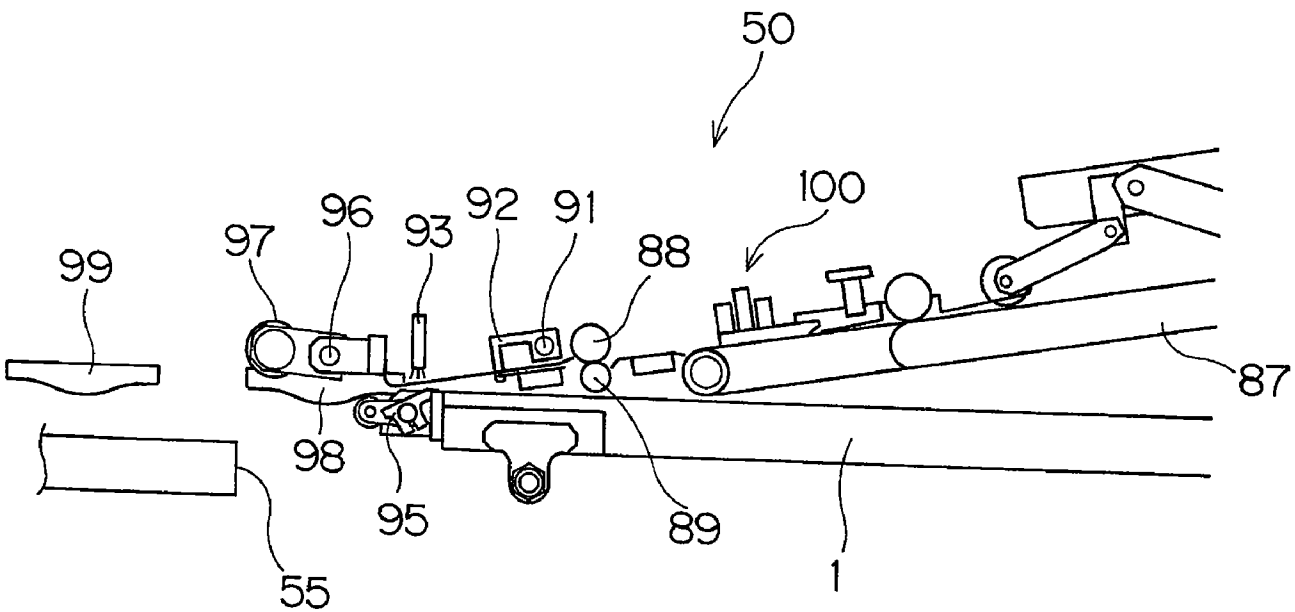
FIG. 15 is a side view showing a feed section with a table.
Figure 16:
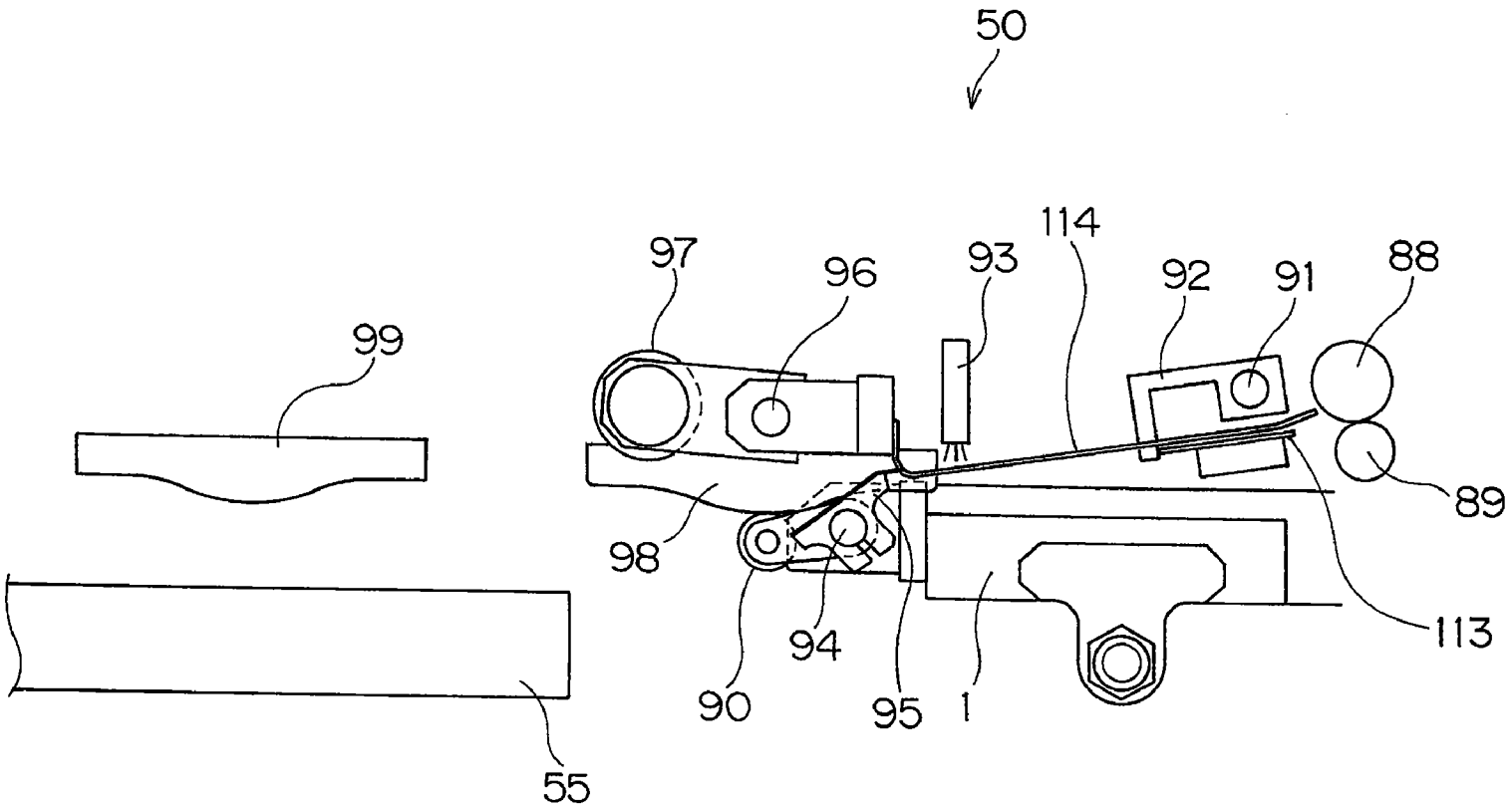
FIG. 16 is an enlarged fragmentary view showing the feed section with a table.

Next, the construction of the paper feeder 2 will be described. As shown in FIGS. 1 and 2, this paper feeder 2 includes a stocker section 40 and a feed section 50. FIG. 14 is a side view of the stocker section 40. FIG. 15 is a side view showing the feed section 50 with a table 1. FIG. 16 is an enlarged view of a principal portion.

As shown in FIG. 14, the stocker section 40 has a paper tray 81 vertically movable with printing paper placed thereon, and a feed sucker 82 for sucking the printing paper on the paper tray 81 and transporting the paper toward a transport roller 86. The printing paper is transported by the feed sucker 82 and transport roller 86 onto a conveyor 87 of the feed section 50. The printing paper placed on the paper tray 81 is surrounded by pickup air blowout elements 83, 84 and 85 for preventing double sheet pickup at times of feeding the paper.

The feed section 50 has the above conveyor 87, a side gauge mechanism 100, feed rollers 88 and 89, a front register device 92, a pair of guide plates 113 and 114, an air discharge nozzle 93 and a squeegee roller 97. The side gauge mechanism 100 serves to position the printing paper transported by the conveyor 87, in a direction perpendicular to the transport direction. The front register device 92 is rockable about an axis 91 to position the forward end of the printing paper transported by the conveyor 87.

The air discharge nozzle 93 blows air toward the forward end of the printing paper when the printing paper is mounted on the tables 1. The upper feed roller 88 of the pair of feed rollers 88 and 89 is constructed vertically movable. The squeegee roller 97 is constructed rockable about an axis 96.

A table clamp 95 is disposed at the forward end in the moving direction of each table 1 for fixing to the table 1 the forward end of the printing paper supplied thereto. The table clamp 95 is rockable about an axis 94 provided on the table 1. Arranged downstream of the feed section 50 with respect to the moving direction of the table 1 are a pair of cams 98 and 99 for opening and closing the table clamp 95, and the suction fan 55 described hereinbefore.

An intersecting angle relative to the table 1 of the printing paper fed from the feed section 50 to the table 1, that is an angle formed between the surface of the table 1 and the pair of guide plates 113 and 114, should be as small as possible. Desirably this angle is 45 degrees or less, and more desirably 30 degrees or less. In order to reduce this angle, the construction employed here has the front register device 92 disposed above the moving region of tables 1.

Figure 17:
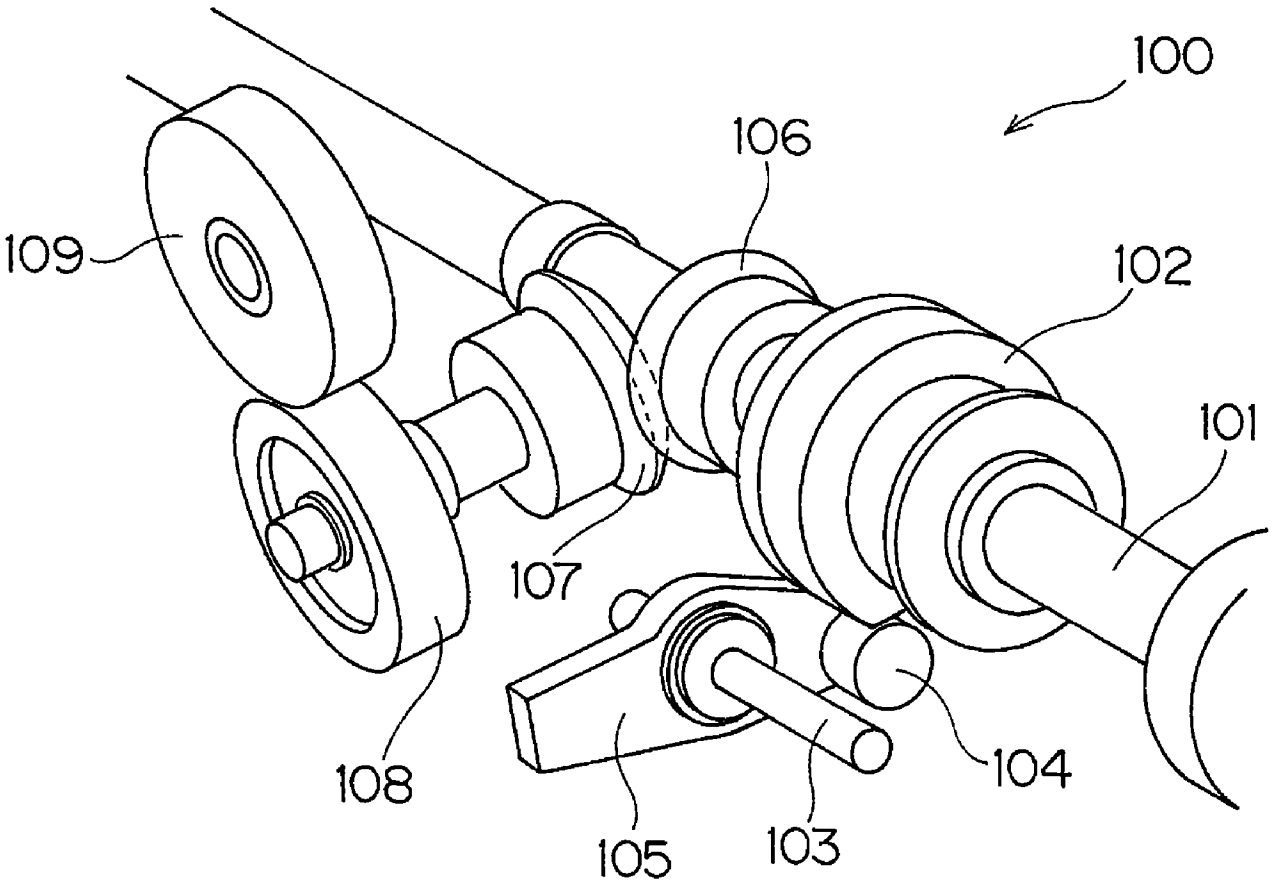
FIG. 17 is a perspective view of a side gauge mechanism.
Figure 18:
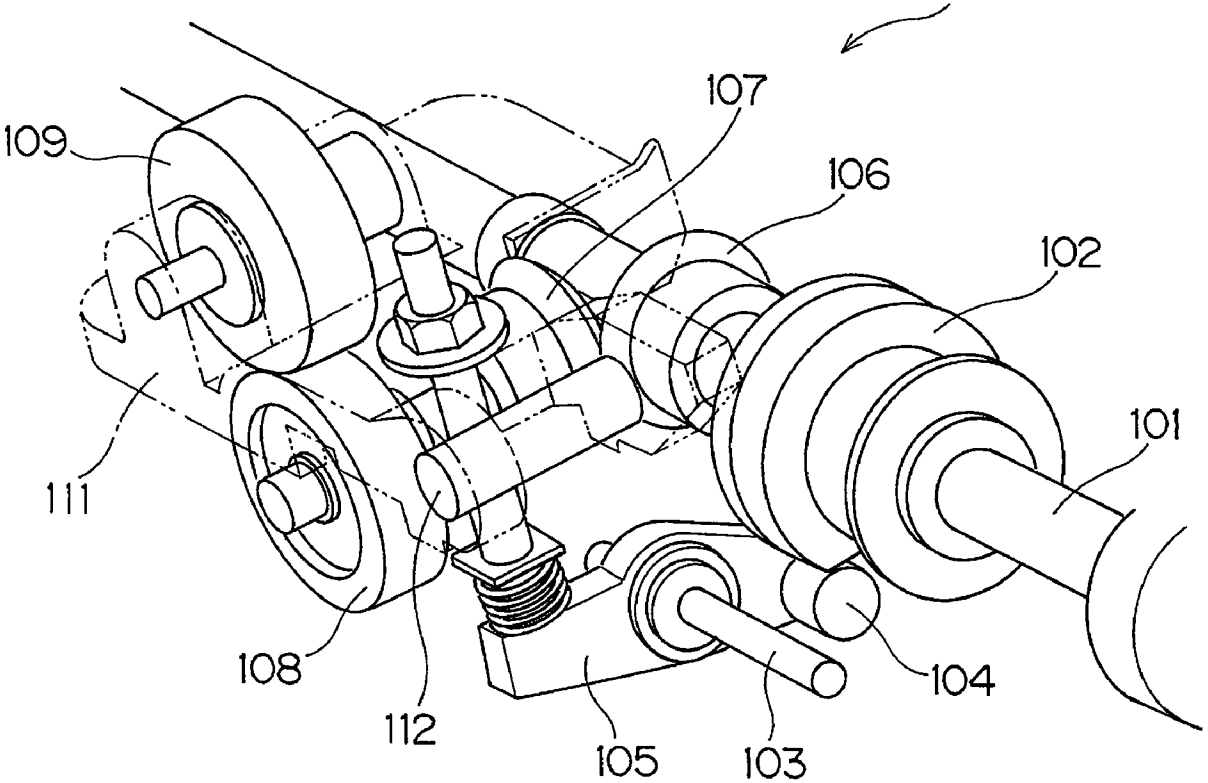
FIG. 18 is a perspective view of the side gauge mechanism.

FIGS. 17 and 18 are perspective views of the side gauge mechanism 100. FIG. 17 omits a lift mechanism of a driven roller 109 and other elements shown in FIG. 18.

This side gauge mechanism 100 includes a drive shaft 101 rotatable synchronously with the drive sprocket 48 (see FIGS. 1 and 2) for moving the tables 1, and a cam 102 and a bevel gear 106 connected to the drive shaft 101. The bevel gear 106 is meshed with a bevel gear 107 connected to a drive roller 108. Thus, the drive roller 108 is rotatable with rotation of the drive shaft 101.

The side gauge mechanism 100 further includes a lever 105 rockable about an axis 103. The lever 105 has a cam follower 104 disposed at one end thereof and in contact with the cam 102 rotatable with the drive shaft 101. The other end of the lever 105 is connected to a casing 111 supporting the driven roller 109. Thus, when the drive shaft 101 rotates, the cam 102 rotates to move up and down the cam follower 104 in contact therewith, which in turn moves the casing 111 up and down. As a result, the driven roller 109 is vertically moved between a rotational position rotatable in contact with the drive roller 108 and a retracted position out of contact with the drive roller 108.

In the side gauge mechanism 100, when the driven roller 109 is in the retracted position, printing paper is fed between the drive roller 108 and driven roller 109. Subsequently, the driven roller 109 is lowered to the rotational position, whereby the printing paper is pinched between the drive roller 108 and driven roller 109. With rotation of the drive roller 108, the printing paper moves in a direction perpendicular to the transport direction to place an edge thereof in contact with a stopper member not shown. In this way, the printing paper transported by the conveyor 87 is positioned in the direction perpendicular to the transport direction. More particularly, the following action takes place. The printing paper is pinched by the pair of drive and driven rollers 108 and 109 of the side gauge mechanism 100, and is in this state moved in the direction perpendicular to the transport direction by the drive roller 108 and driven roller 109 to be positioned in this direction with an edge of the paper contacting the stopper member not shown. Then, the driven roller 109 is raised, thereby canceling the nipping of the printing paper by the pair of rollers 108 and 109 of the side gauge mechanism 100.

In this feed section 50, the printing paper fed from the stocker section 40 is transported by the conveyor 87. At this time, the upper feed roller 88 of the pair of feed rollers 88 and 89 is separated from the lower feed roller 89. The transported printing paper passes through between the pair of feed rollers 88 and 89, and stops when its forward end contacts the front register device 92. In this state, the side gauge mechanism 100 is operated to position the printing paper transported by the conveyor 87, in the direction perpendicular to the transport direction.

Next, the feed roller 88 descends to pinch the printing paper between the pair of feed rollers 88 and 89, and the front register device 92 rocks up. The printing paper is transported toward the table clamp 95 of the table 1 by the action of the pair of feed rollers 88 and 89. The transporting speed of the printing paper at this time is slightly faster than the moving speed of the table 1. At this time, as shown in FIG. 16, with the movement of the table 1 driven by the linear motor mechanisms 61, a cam follower 90 disposed opposite the table clamp 95 across the axis 94 contacts the cam 98 for opening and closing the table clamp 95, to keep the table clamp 95 in an open state.

When the forward end of the printing paper reaches the table clamp 95, the table clamp 95 is closed. That is, with movement of the table 1 driven by the chain 44, the cam follower 90 disposed opposite the table clamp 95 across the axis 94 moves away from the cam 98 for opening and closing the table clamp 95, whereby the table clamp 95 is closed. The printing paper is fixed to the table 1 by the table clamp 95.

When the printing paper is fixed to the table 1 by the table clamp 95 in this way, air is blown from the air discharge nozzle 93 to the forward end of the printing paper. Thus, the printing paper is pressed on the surface of the table 1, thereby reliably fixing the printing paper between the table clamp 95 and table 1.

When the table 1 moves further by the drive of linear motor mechanisms 61, the printing paper on the table 1 is squeezed by the squeegee roller 97, and is held by suction on the table 1 by the action of the suction fan 55. Subsequently, the cam follower 90 contacts the second cam 99 for opening and closing the table clamp 95, thereby to open and close the table clamp 95, and eliminate any distortion of the forward end of the printing paper.

Figure 19:
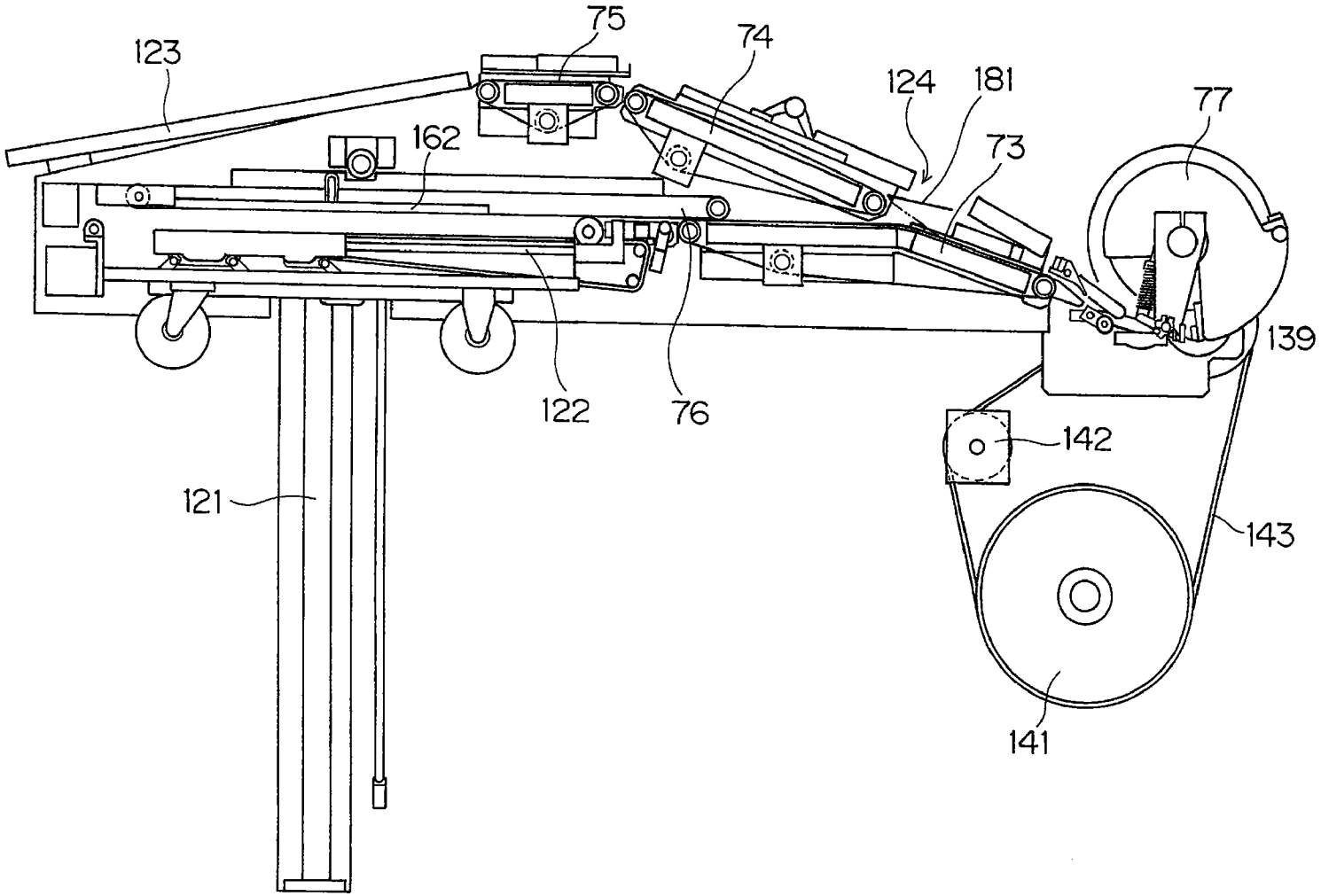
FIG. 19 is a schematic side view of a paper discharger.

Next, the construction of the paper discharger 4 noted hereinbefore will be described. FIG. 19 is a schematic side view of the paper discharger 4.

The paper discharger 4 includes a paper discharge cylinder 77 having a first peeling claw and a claw seat described hereinafter, for wrapping peripherally thereof the printing paper pinched and transported by the peeling claw and claw seat to separate the printing paper from each table 1. The construction and paper separating operation of the discharge cylinder 77 will be described in detail hereinafter.

This paper discharger 4 further includes a first conveyor 73 and a second conveyor 76 for transporting the printing paper received from the discharge cylinder 77 to a stocker section 122 vertically movable as guided by a guide 121, a third conveyor 74 and a fourth conveyor 75 for transporting the printing paper received from the discharge cylinder 77 to a paper discharge table 123, and a switching mechanism 124 for switching transport paths.

Figure 20:
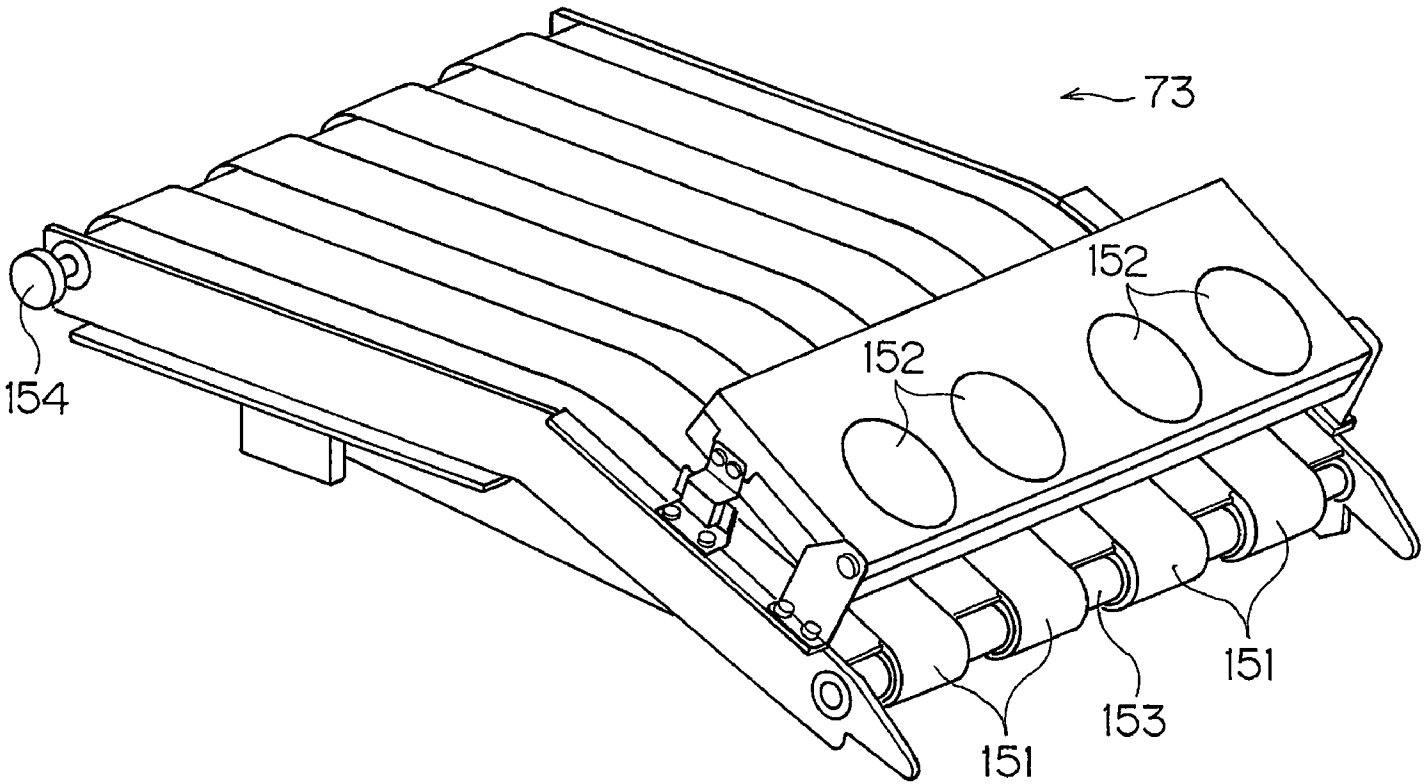
FIG. 20 is a perspective view of a first conveyor.

FIG. 20 is a perspective view of the first conveyor 73.

The first conveyor 73 has four belts 151 wound around a shaft 153 and a shaft 154. In the first conveyor 73, the printing paper transported by the discharge cylinder 77 is placed on the belts 151 to be transported. Fans 152 are arranged in positions opposed to sloping portions of the belts 151 of the first conveyor 73 for blowing air toward the printing paper transported by the first conveyor 73. This assures that the printing paper is transported reliably by the belts 151 of the first conveyor 73.

Figure 21:
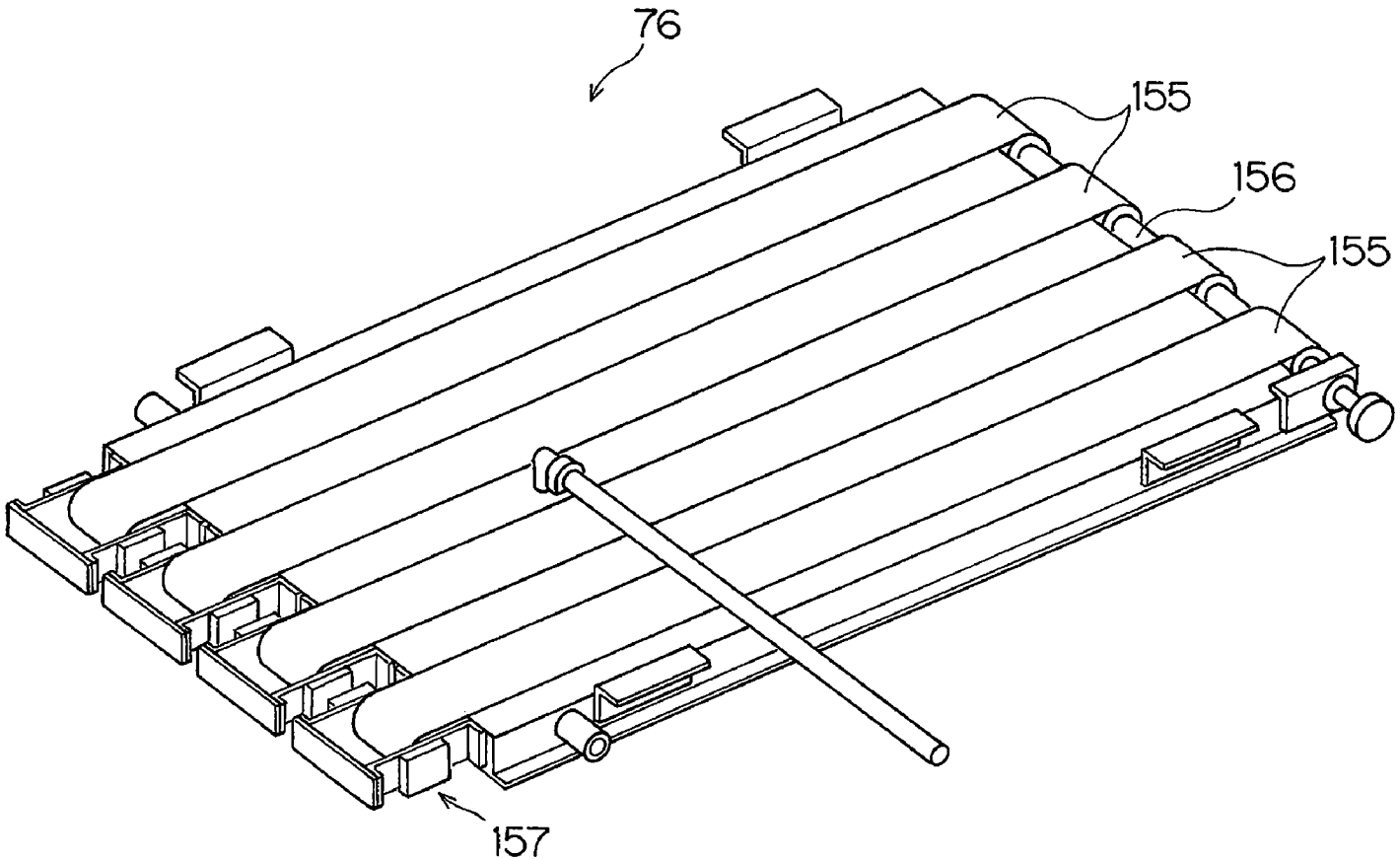
FIG. 21 is a perspective view of a second conveyor.

FIG. 21 is a perspective view of the second conveyor 76.

The second conveyor 76 is constructed to hold by suction from above and transport the printing paper transported by the first conveyor 73, and has four belts 155 wound around a shaft 156 and a shaft 157.

Figure 22:
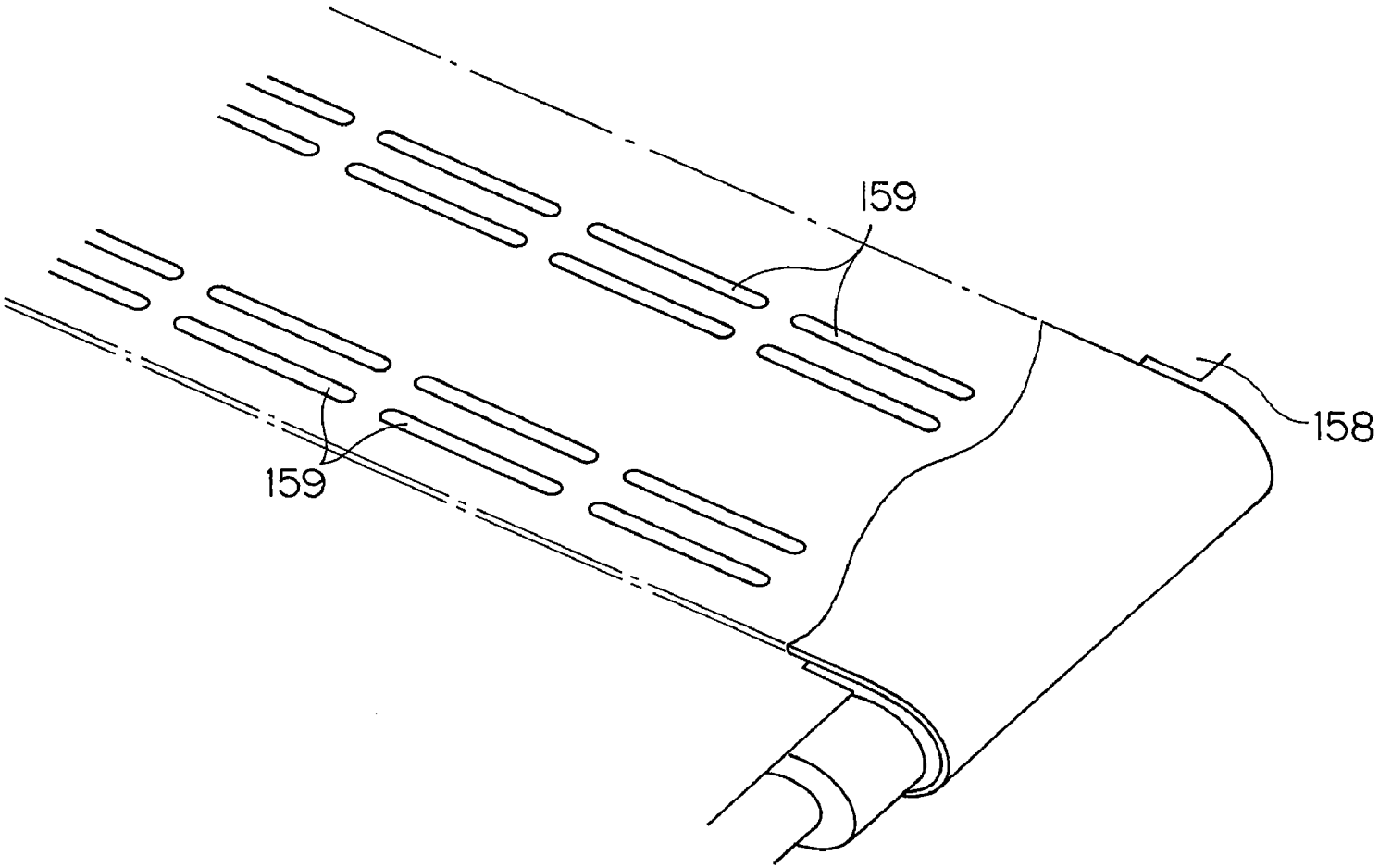
FIG. 22 is a fragmentary perspective view of the second conveyor seen from the back surface thereof.
Figure 23:
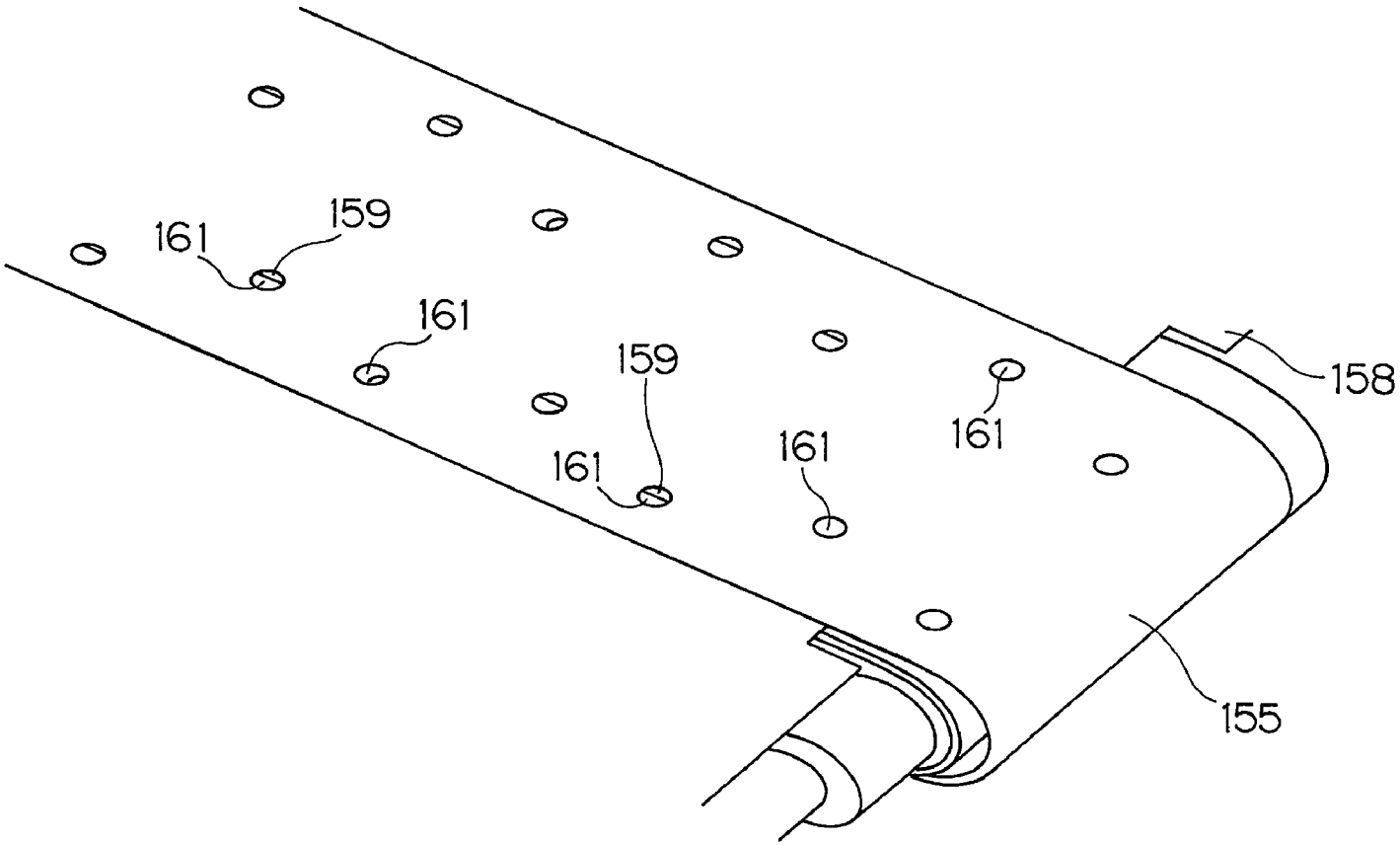
FIG. 23 is a fragmentary perspective view of the second conveyor seen from the back surface thereof.

FIGS. 22 and 23 are fragmentary perspective views of the second conveyor 76 seen from the back surface thereof. FIG. 22 shows a state with the belts 155 detached.

A region between the belts 155 of the second conveyor 76 defines a chamber. As shown in FIG. 22, numerous slits 159 are formed in a plate 158 defining a lower surface of this chamber. As shown in FIG. 23, numerous bores 161 are formed in the belts 155. These slits 159 and bores 161 are formed in positions corresponding to each other. Thus, by decompressing the interior of the chamber between the belts 155, the printing paper can be sucked through the slits 159 and bores 161. The printing paper is transported as held by the belts 155 by suction applied from above.

By stopping decompression of the chamber between the belts 155 with proper timing, the suction holding of the printing paper by the belts 155 is canceled.

Alternatively, the slits 159 may be formed only in regions of the belts 155 upstream with respect to the transport direction of the printing paper. Then, the suction holding of the printing paper by the belts 155 is carried out in the portion of the second conveyor 76 downstream with respect to the transport direction, and the printing paper is released from the suction holding in the portion of the second conveyor 76 downstream with respect to the transport direction.

As shown in FIG. 19, an air blast pipe 162 is disposed in a middle position in a direction perpendicular to the transport direction of the printing paper in the second conveyor 76. The air blast pipe 162 has a plurality of air blowout bores formed in succession in the transport direction of the printing paper.

Figure 24:
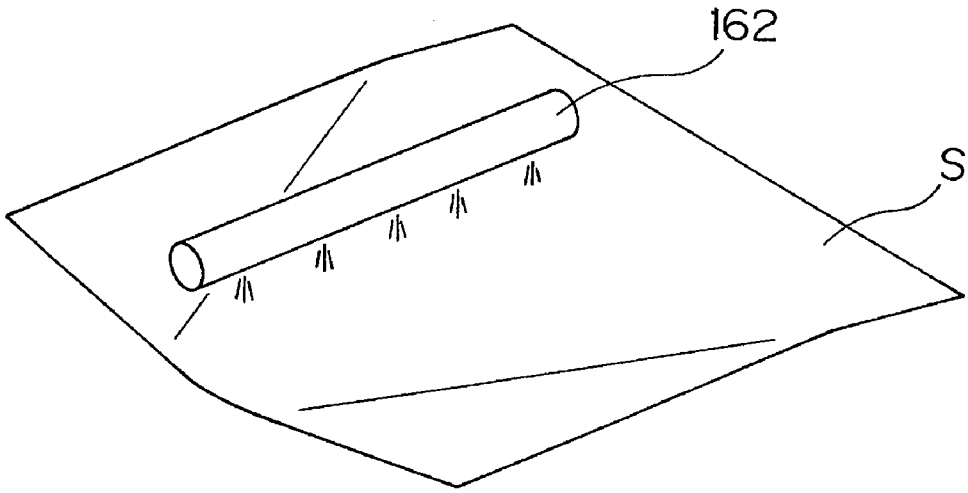
FIG. 24 is an explanatory view showing how an air blast pipe blows air to printing paper.

FIG. 24 is an explanatory view showing how the air blast pipe 162 blows air to the printing paper S.

When the forward end of the printing paper reaches a downstream region in the transport direction of the second conveyor 76, the decompression in the chamber between the belts 155 is stopped to cancel the suction holding of the printing paper. In this region, the air blast pipe 162 blows air toward the middle position of the printing paper S with respect to the direction perpendicular to the transport direction. Consequently, the printing paper is folded along the middle position, and falls into the stocker section 122. It is thus possible to drop the recording medium correctly in the stocker section 122.

Figure 25:
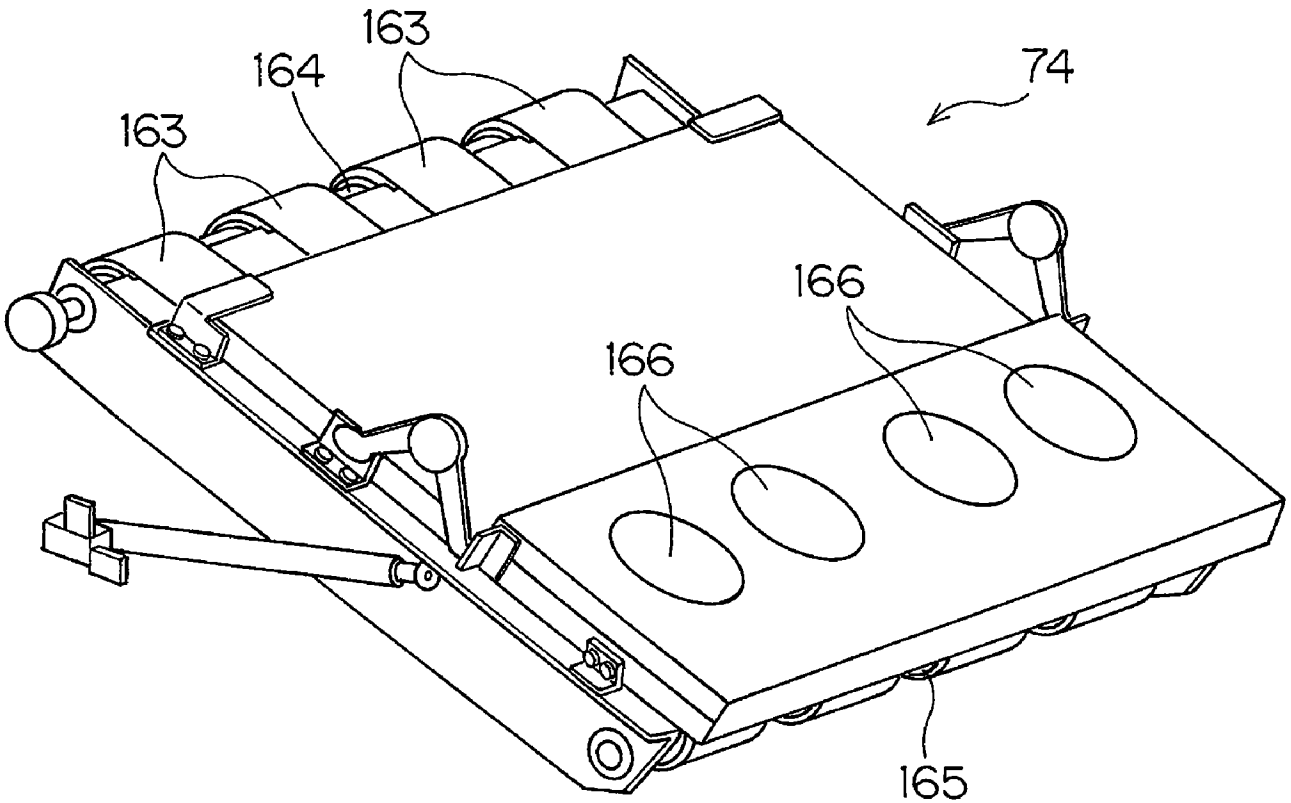
FIG. 25 is a perspective view of a third conveyor.

FIG. 25 is a perspective view of the third conveyor 74.

The third conveyor 74 has four belts 163 wound around a shaft 164 and a shaft 165. In the third conveyor 74, the printing paper placed on and transported by the belts 151 of the first conveyor 73, and directed by the transport path switching mechanism 124 to the third conveyor 74, is placed on and transported by the belts 163. Fans 166 are arranged in positions opposed to the belts 163 of the third conveyor 74 for blowing air toward the printing paper transported by the third conveyor 74. This assures that the printing paper is transported reliably by the belts 163 of the third conveyor 74.

Figure 26:
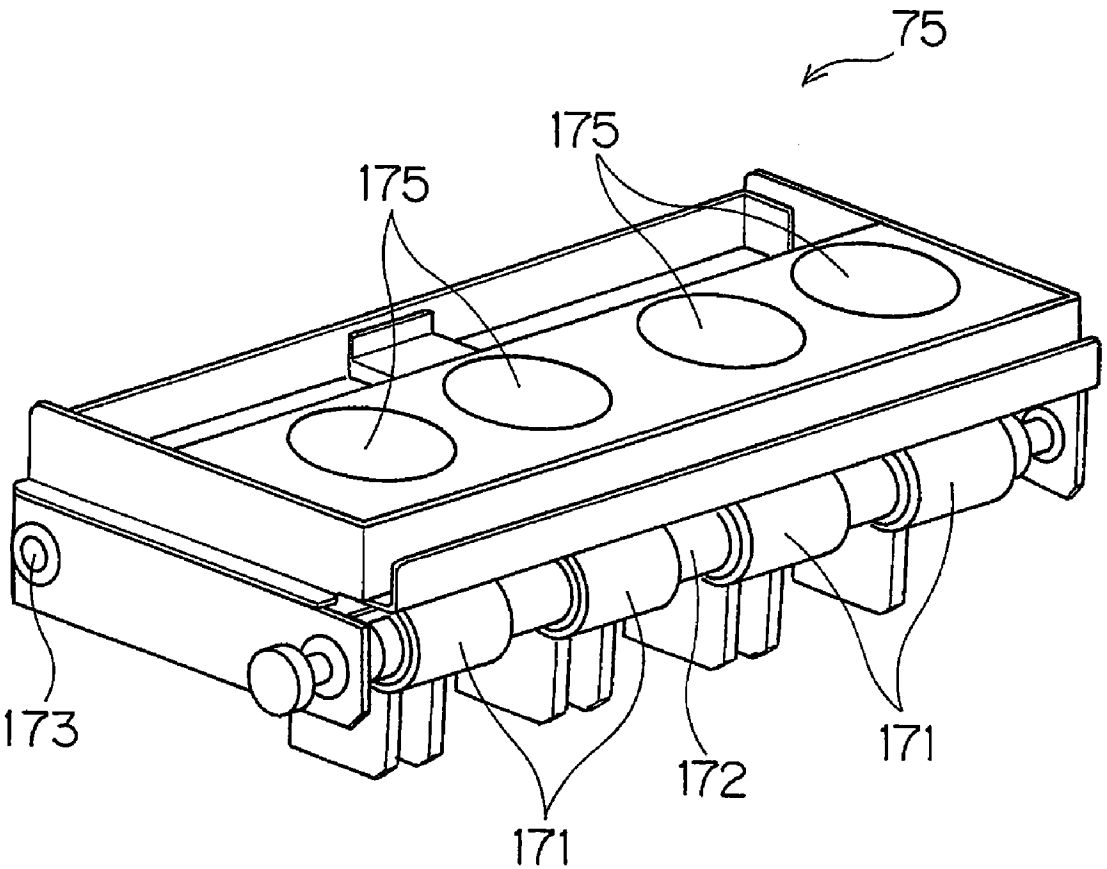
FIG. 26 is a perspective view of a fourth conveyor.

FIG. 26 is a perspective view of the fourth conveyor 75.

The fourth conveyor 75 has four belts 171 wound around a shaft 172 and a shaft 173. In the fourth conveyor 75, the printing paper placed on and transported by the belts 163 of the third conveyor 74 is placed on and transported by the belts 171. Fans 175 are arranged in positions opposed to the belts 171 of the fourth conveyor 75 for blowing air toward the printing paper transported by the fourth conveyor 75. This assures that the printing paper is transported reliably by the belts 171 of the fourth conveyor 75.

Figure 27:
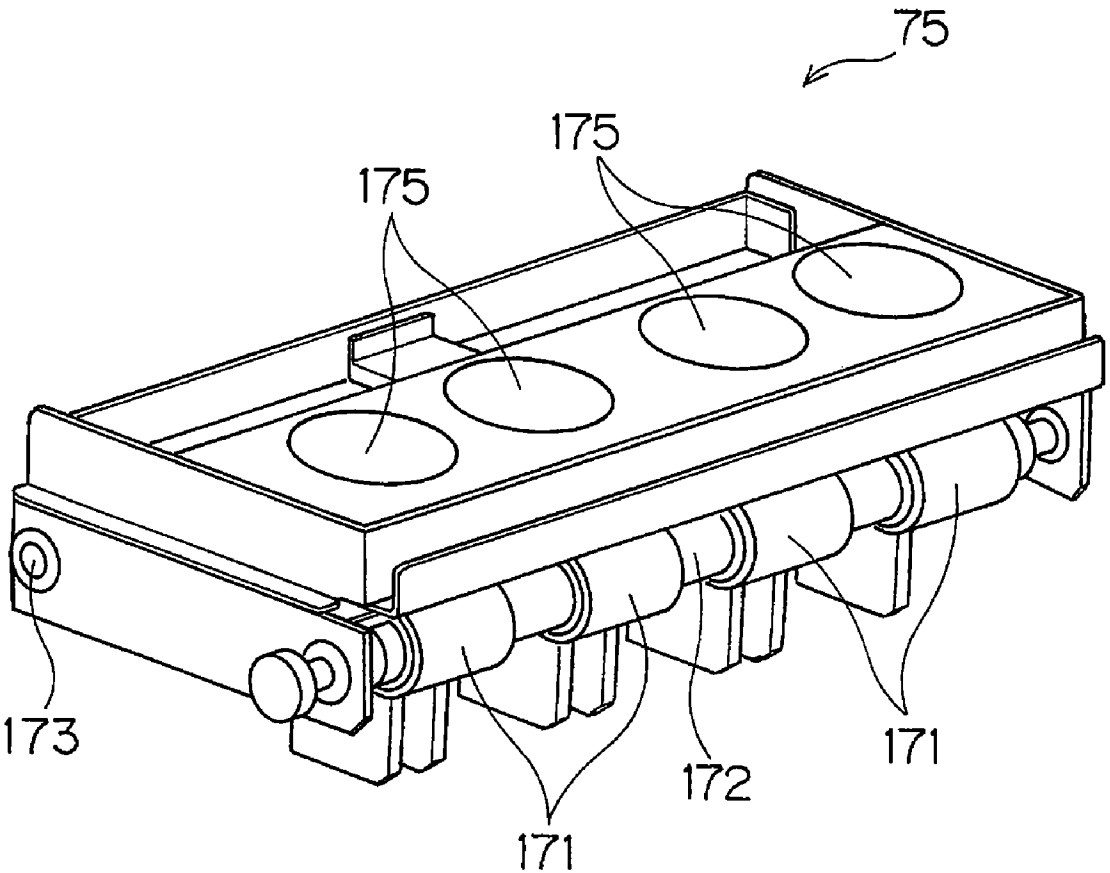
FIG. 27 is a perspective view of a switching mechanism.

FIG. 27 is a perspective view of the switching mechanism 124.

The switching mechanism 124 includes a guide plate 181 rockable about an axis 183 by the drive of a solenoid 182. When the guide plate 181 is located in the position shown in solid lines in FIGS. 19 and 27, the printing paper discharged from the discharge cylinder 77 and placed on and transported by the belts 151 of the first conveyor 73 remains on the belts 151 and transported to the second conveyor 76. When the guide plate 181 is located in the position shown in phantom lines in FIGS. 19 and 27, the printing paper discharged from the discharge cylinder 77 and placed on and transported by the belts 151 of the first conveyor 73 is transported to the third conveyor 74.

In the above construction, the printing paper on each table 1 is separated from the table 1 by the action of the discharge cylinder 77, wound peripherally of the discharge cylinder 77 and transported to the first conveyor 73, as described hereinafter. After being placed on the upper portion of and transported by the first conveyor 73, the printing paper is transported with the upper surface held by suction by the second conveyor 76. The printing paper is released from the suction above the stocker section 122, and is subjected to the air blown from the air blast pipe 162 toward the middle position in the direction perpendicular to the transport direction. Consequently, the printing paper is folded along the middle position, and falls into the stocker section 122 to be collected in the stocker section 122.

When the printing paper with an image printed is to be checked visually, the switching mechanism 124 disposed on the first conveyor 73 guides the printing paper transported by the first conveyor 73 toward the third conveyor 74. The printing paper is placed on and transported by the third conveyor 74 and fourth conveyor 75, and is then discharged onto the paper discharge table 123.

Figure 28A:
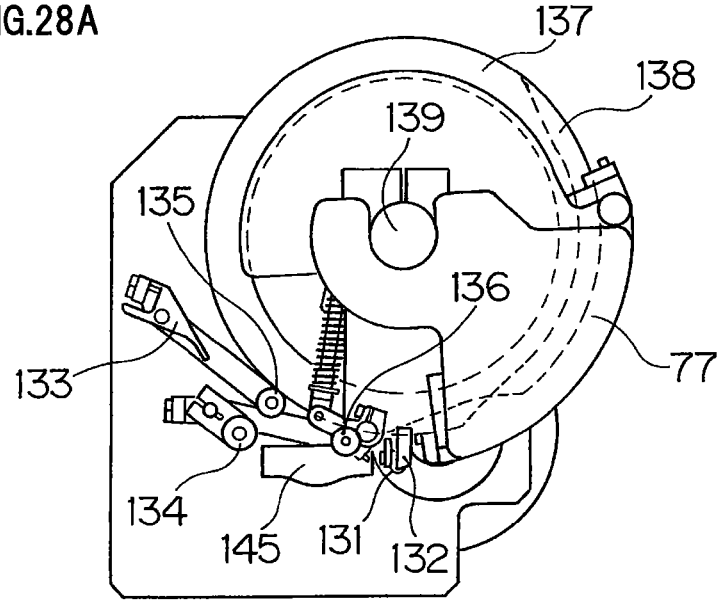
FIG. 28A is a side view showing a paper discharge cylinder and associated elements.
Figure 28B:
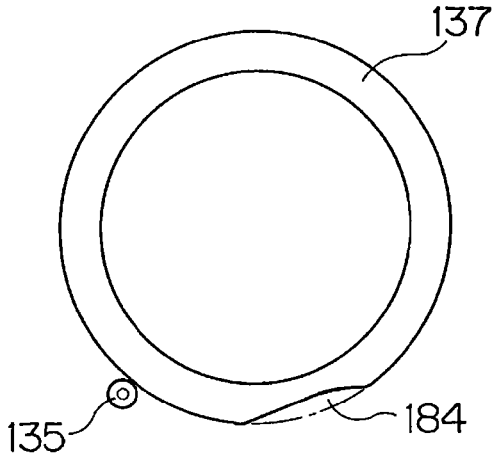
FIG. 28B is a side view showing the paper discharge cylinder and associated elements.
Figure 28C:
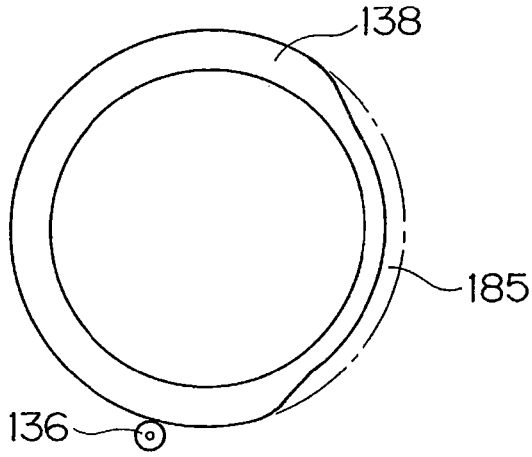
FIG. 28C is a side view showing the paper discharge cylinder and associated elements.

Next, the construction and paper separating operation of the paper discharge cylinder 77 noted hereinbefore will be described. FIGS. 28A, 28B and 28C are side views showing the discharge cylinder 77 and associated elements.

The discharge cylinder 77 is formed of a section of a cylindrical shape, and is rotatable about a shaft 139. As shown in FIG. 19, the discharge cylinder 77 is connected to a drive pulley 141 and a driven pulley 142 through a belt 143, to be rotatable by the drive of the drive pulley 141.

As shown in FIG. 28A, the discharge cylinder 77 includes a first peeling claw 131 for peeling the forward end of the printing paper from the table 1, a claw seat 132 for pinching and transporting the forward end of the printing paper with the first peeling claw 131, a nip roller 134 for pressing the printing paper to the peripheral surface of the discharge cylinder 77, and a second peeling claw 133 for peeling the printing paper wrapped on the discharge cylinder 77 from the discharge cylinder 77.

As shown in FIGS. 28B and 28C, a first cam 137 and a second cam 138 are arranged laterally of the discharge cylinder 77. The first cam 137 is provided for contacting a cam follower 135 to drive the second peeling claw 133. When the cam follower 135 contacts a recess 184 in the first cam 137, the second peeling claw 133 performs a peeling operation described hereinafter. The second cam 138 is provided for contacting a cam follower 136 to drive the nip roller 134. When the cam follower 136 contacts a recess 185 in the second cam 138, the nip roller 134 contacts the surface of the discharge cylinder 77.

Figure 29:
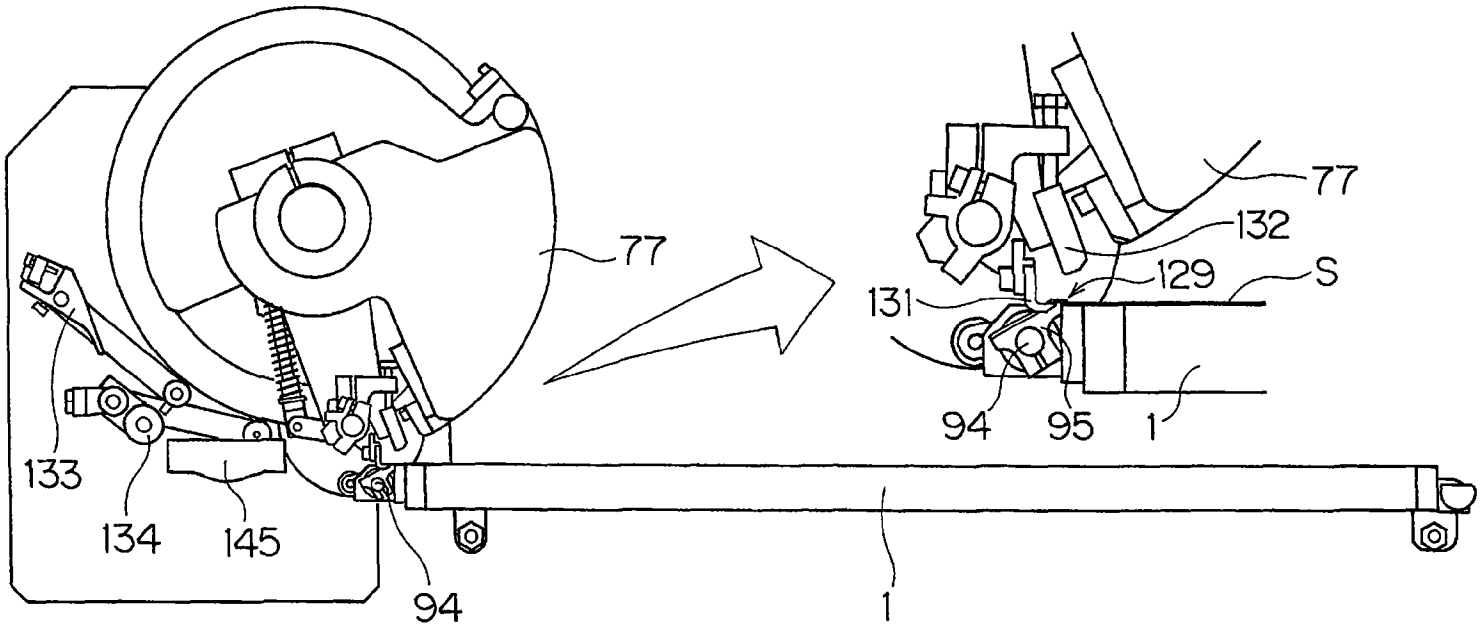
FIG. 29 is a side view showing the paper discharge cylinder and associated elements.
Figure 30:
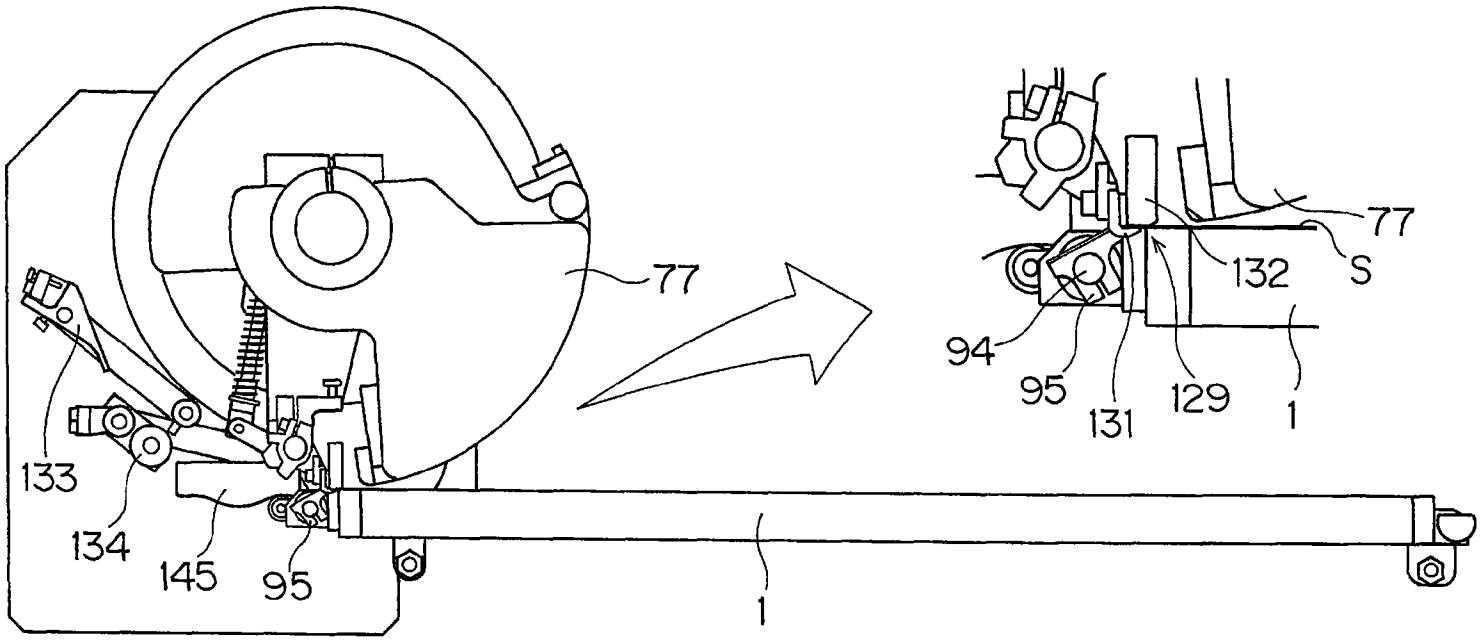
FIG. 30 is a side view showing the paper discharge cylinder and associated elements.
Figure 31:
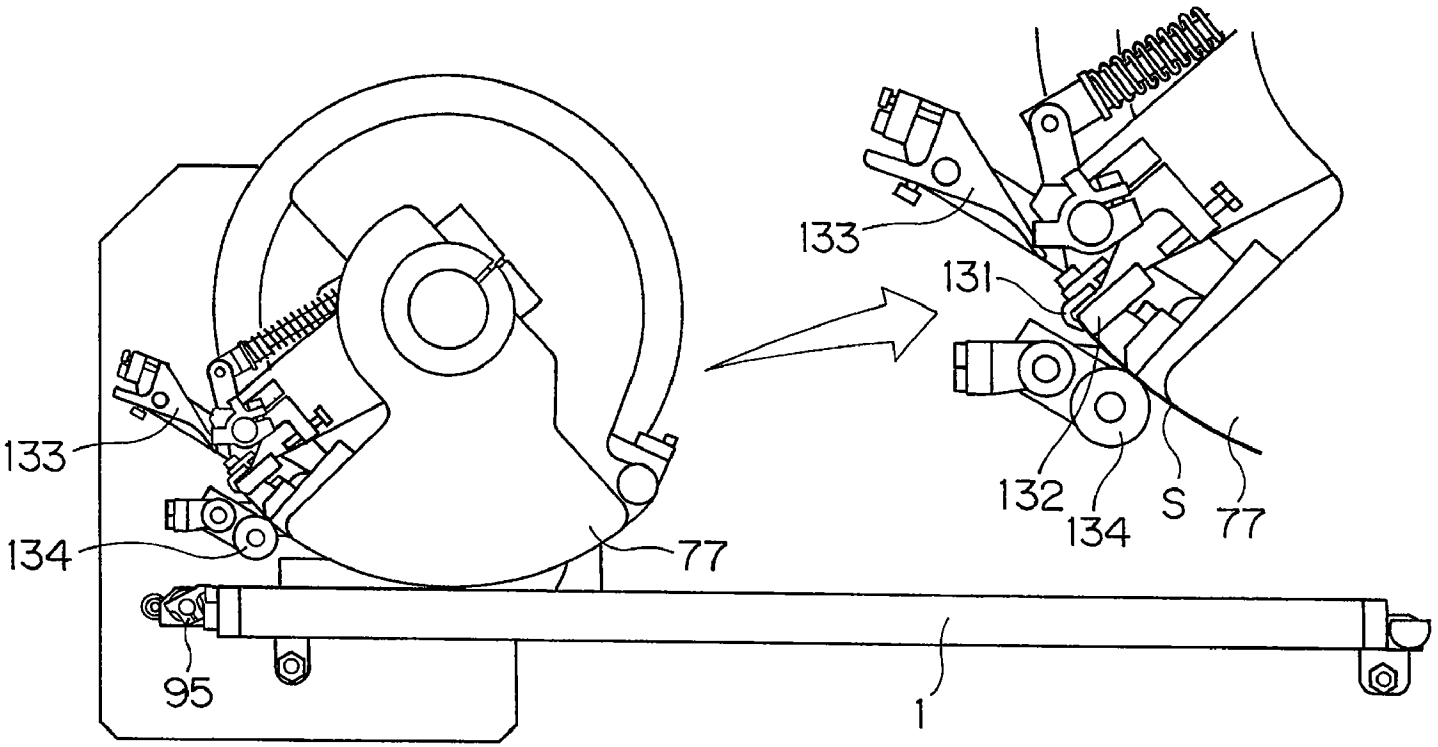
FIG. 31 is a side view showing the paper discharge cylinder and associated elements.

Next, a discharging operation for discharging the printing paper from the table 1 using the discharge cylinder 77 will be described. FIGS. 29 through 31 are explanatory views showing the discharging operation for discharging the printing paper S from the table 1.

When the table 1 is transported up to the discharge cylinder 77 by the table moving mechanism 5, the first peeling claw 131 first moves into cutouts 129 (see FIGS. 6 and 29) formed at the forward end of the table 1. In this state, the table clamp 95 is closed, and the printing paper S is fixed to the table 1 by the table clamp 95.

As the table 1 moves from this state, as shown in FIG. 30, the cam follower 90 disposed opposite the table clamp 95 across the axis 94 of the table 1 contacts a cam 145 for operating the table clamp 95, thereby opening the table clamp 95. The discharge cylinder 77 rotates synchronously with the movement of the table 1, and the first peeling claw 131 is moved by a link mechanism not shown, whereby the printing paper S is pinched between the first peeling claw 131 and claw seat 132.

The displacement volume of the suction fan 55 noted hereinbefore is set to become small when the tables 1 are located near the paper discharger 4. Thus, when the first peeling claw 131 peels the forward end of the printing paper from the table 1, the suction holes 11 hold the printing paper with a reduced force of suction.

When the table 1 moves further from this state, as shown in FIG. 31, the discharge cylinder 77 further rotates synchronously with the movement of the table 1, and the printing paper S pinched between the first peeling claw 131 and claw seat 132 moves toward the second peeling claw 133. The nip roller 134 descends onto the printing paper S, and presses the printing paper S on the discharge cylinder 77.

As the table 1 moves further from this state, the discharge cylinder 77 further rotates synchronously with the movement of the table 1, and the first peeling claw 131 is moved by the link mechanism not shown to release the printing paper S. The printing paper S is separated from the discharge cylinder 77 by the second peeling claw 133, and is transported toward the first conveyor 73 noted hereinbefore. Thus, in this paper discharger 4, the first peeling claw 131 and claw seat 132 pick up the printing paper from the table 1, place the printing paper in tight contact with the surface of the discharge cylinder 77, and thereafter the second peeling claw 133 separates the printing paper from the surface of the discharge cylinder 77. This paper grip swapping process realizes a reliable and accurate transport of the printing paper even if the printing paper has variations in weight, flatness, and the like.

In the image recording apparatus having the above construction, printing paper fed from the paper feeder 2 is supplied onto tables 1 movable by the endless transport mechanism of the table moving mechanism 5. After each table 1 is transferred from the endless transport mechanism to the linear motor mechanisms 61 of the table moving mechanism 5, an image is recorded by the image recording unit 3. Subsequently, the table 1 is transferred from the linear motor mechanisms 61 to the endless transport mechanism, and then the printing paper on the table 1 is discharged by the paper discharger 4. Thus, images can be recorded at high speed and with high precision.

While the foregoing embodiment has been described to record images on printing paper, this invention is similarly applicable to image recording apparatus for recording images on other recording media.

This invention may be embodied in other specific forms without departing from the spirit or essential attributes thereof and, accordingly, reference should be made to the appended claims, rather than to the foregoing specification, as indicating the scope of the invention.

This application claims priority benefit under 35 U.S.C. Section 119 of Japanese Patent Application No. 2008-090778 filed in the Japanese Patent Office on Mar. 31, 2008, Japanese Patent Application No. 2008-090779 filed in the Japanese Patent Office on Mar. 31, 2008, Japanese Patent Application No. 2008-090780 filed in the Japanese Patent Office on Mar. 31, 2008, and Japanese Patent Application No. 2009-22577 filed in the Japanese Patent Office on Feb. 3, 2009, the entire disclosure of which is incorporated herein by reference.

What is claimed is:

1. An image recording apparatus comprising:

an endless transport mechanism including a pair of roller members, a drive mechanism for rotating said roller members, and an endless cord member wound around said roller members;

a plurality of tables each for holding a recording medium on a surface thereof;

a guide mechanism for guiding said tables to be movable along a track corresponding to said endless cord member;

a linear motor mechanism including a plurality of movers and a stator for reciprocating said movers along the track of movement of said tables;

a first connecting mechanism including a first connector attached to said endless cord member of said endless transport mechanism, a second connector attached to each of said tables, and a first switching mechanism for switching said first connector and said second connector between a connected state and a released state;

a second connecting mechanism including a third connector attached to each of the movers of said linear motor mechanism, a fourth connector attached to each of said tables, and a second switching mechanism for switching said third connector and said fourth connector between a connected state and a released state;

a recording medium feed mechanism for feeding the recording medium to each of said tables in movement;

a recording head disposed above the tables moved by drive of said linear motor mechanism, each in a state of having said third connector and said fourth connector connected by said second connecting mechanism, for recording an image by discharging inks onto the recording medium from a plurality of inkjet nozzles arranged in a direction crossing a moving direction of the tables; and a recording medium discharge mechanism for discharging, from each of said tables, the recording medium with the image recorded by said recording head;

wherein said first switching mechanism is arranged to disconnect said first connector and said second connector before each of said tables is opposed to said recording head, and to connect said first connector and said second connector after each of said tables is opposed to said recording head; and said second switching mechanism is arranged to connect said third connector and said fourth connector before each of said tables is opposed to said recording head, and to disconnect said third connector and said fourth connector after each of said tables is opposed to said recording head.

2. The image recording apparatus according to claim 1, wherein said first switching mechanism is arranged to connect said first connector and said second connector by placing said first connector and said second connector in a tight fitting state, and to disconnect said first connector and said second connector by placing said first connector and said second connector in a loose fitting state.

3. The image recording apparatus according to claim 1, wherein:

said fourth connector of said second connecting mechanism has a V-block formed on a lower surface of each of said tables;

said third connector has a cam follower for engaging said V-block; and said second switching mechanism has a lever for moving said cam follower between a connecting position for contacting said V-block and a release position out of contact with said V-block, and a cam mechanism for rocking said lever.

4. The image recording apparatus according to claim 1, wherein said recording medium feed mechanism is arranged to attach the recording medium in sheet form to the surface of each of the tables moving in one direction, said recording medium feed mechanism including:

a table clamp disposed at a forward end in the moving direction of each of said tables;

a transport mechanism for transporting the recording medium toward the surface of each of said tables from a direction above said tables and at a small intersecting angle to the surface of each of said tables, and at a speed slightly faster than a moving speed of said tables; and a clamp operating mechanism for closing said table clamp when the forward end of the recording medium transported by said transport mechanism reaches said table clamp, to fix the recording medium to each of said tables with the table clamp.

5. The image recording apparatus according to claim 1, wherein said recording medium discharge mechanism is arranged to discharge the recording medium in sheet form from the surface of each of the tables moving in one direction, and transport the recording medium to a stocker section;

each of the table having a table clamp disposed at a forward end in the moving direction thereof for fixing the recording medium, and cutouts formed at the forward end for peeling off the recording medium;

said recording medium discharge mechanism including:

a first peeling claw for moving into said cutouts for peeling, and peeling a forward end of the recording medium from each of said tables;

a claw seat for pinching the forward end of the recording medium and transporting the recording medium with said first peeling claw;

a discharge cylinder for winding peripherally thereof the recording medium pinched and transported by said first peeling claw and said claw seat to separate the recording medium from each of said tables;

a second peeling claw for peeling the recording medium from said discharge cylinder;

a first conveyor for receiving and transporting thereon the recording medium peeled from the discharge cylinder by said second peeling claw;

a second conveyor for holding by suction from above and transporting the recording medium transported by said first conveyor; and the stocker section for collecting the recording medium falling upon cancellation of suction holding after being transported by said second conveyor.

6. The image recording apparatus according to claim 2, wherein:

said second connector of said first connecting mechanism has a construction defining a substantially triangular bore; and said first connector has a connecting pin erected on the cord member for insertion into said bore;

said first connector and said second connector being connected to each other by said connecting pin contacting a corner of said substantially triangular bore, and disconnected from each other by said connecting pin moving away from said corner of said substantially triangular bore with a variation in height of said cord member.

7. The image recording apparatus according to claim 3, further comprising a fixing device for fixing said cam follower to said release position when said third connector moves counter to the moving direction of said tables.

8. The image recording apparatus according to claim 4, further comprising an air discharge nozzle for blowing air from above each of said tables toward the forward end of the recording medium when the recording medium is fixed to each of said table with said table clamp.

9. The image recording apparatus according to claim 4, wherein said transport mechanism includes a front register mechanism for contacting the forward end of the recording medium transported, and temporarily stopping the recording medium.

10. The image recording apparatus according to claim 4, wherein said tables are movable along a circulating track by using the endless transport mechanism including the pair of roller members, the drive mechanism for rotating said roller members, and the endless cord member wound around said roller members.

11. The image recording apparatus according to claim 5, wherein each of said tables has a sucking device formed therein for holding the recording medium by suction, said sucking device having a suction holding force reduced when said first peeling claw peels the forward end of the recording medium from each of said tables.

12. The image recording apparatus according to claim 5, wherein said discharge cylinder has a nip roller disposed peripherally thereof for pressing the recording medium on a peripheral surface of said discharge cylinder.

13. The image recording apparatus according to claim 5, further comprising a fan disposed opposite said first conveyor for blowing air toward the recording medium transported by the first conveyor.

14. The image recording apparatus according to claim 5, further comprising an air blast device for blowing air toward a middle position in a direction perpendicular to the transport direction of the recording medium falling upon cancellation of the suction holding after being transported by said second conveyor.

15. The image recording apparatus according to claim 5, wherein said tables are movable along a circulating track by using the endless transport mechanism including the pair of roller members, the drive mechanism for rotating said roller members, and the endless cord member wound around said roller members.

16. The image recording apparatus according to claim 9, wherein said transport mechanism includes feed rollers for forwarding the recording medium temporarily stopped by said front register mechanism.

17. The image recording apparatus according to claim 9, wherein said front register mechanism is disposed above a moving region of said tables.

* * * * *